US012516604B1

(12) United States Patent
Dalamarinis et al.

(10) Patent No.: US 12,516,604 B1
(45) Date of Patent: Jan. 6, 2026

(54) METHODS AND SYSTEMS FOR IMPROVING EXTRACTION OF PETROCHEMICALS FROM PETROCHEMICAL WELLS

(71) Applicant: DG Petro Oil & Gas, LLC, Allen, TX (US)

(72) Inventors: Panagiotis Dalamarinis, Allen, TX (US); Stephen Gregory Fusselman, Allen, TX (US)

(73) Assignee: DG Petro Oil & Gas, LLC, Allen, TX (US)

( * ) Notice: Subject to any disclaimer, the term of this patent is extended or adjusted under 35 U.S.C. 154(b) by 0 days.

(21) Appl. No.: 19/094,336

(22) Filed: Mar. 28, 2025

Related U.S. Application Data

(60) Provisional application No. 63/753,102, filed on Feb. 3, 2025.

(51) Int. Cl.
*E21B 49/08* (2006.01)
*E21B 37/06* (2006.01)

(52) U.S. Cl.
CPC ..... *E21B 49/0875* (2020.05); *E21B 37/06* (2013.01); *E21B 49/088* (2013.01); *E21B 2200/20* (2020.05)

(58) Field of Classification Search
CPC .... E21B 49/0875; E21B 37/06; E21B 49/088; E21B 2200/20
See application file for complete search history.

(56) References Cited

U.S. PATENT DOCUMENTS 9,284,722 B2 * 3/2016 Heller ..... E03B 3/08
11,603,757 B2 * 3/2023 Proett ..... E21B 49/008
2023/0272263 A1 * 8/2023 Farmer ..... C09K 8/74 507/90

FOREIGN PATENT DOCUMENTS

CA 3009039 A1 * 6/2017 ..... B09B 3/70

OTHER PUBLICATIONS

Dalamarinis P., Smith B., Fusselman S.: "Acid Restimulation in Legacy Wolfcamp Wells Utilizing Chlorine Dioxide (CLO2). An Operator Case Study of Reservoir Conductivity and Near Wellbore Fracture System Reactivation," URTeC: 3818857 presented at Unconventional Resources Technology Conference, Denver, Colorado, USA, Jun. 13-15, 2023.

(Continued)

*Primary Examiner* — Catherine Loikith
(74) *Attorney, Agent, or Firm* — PIERSON FERDINAND LLP; Keats Quinalty

(57) ABSTRACT

Methods and systems for improving extraction of petrochemicals from petrochemical wells in conventional or unconventional reservoirs. The methods and systems operate by identifying contaminants in one or more samples obtained from a petrochemical well and, based on the identification of the contaminants present in the one or more samples, identifying a composition and pumping schedule configured to remove the contaminants from the petrochemical well. The contaminants may comprise various combinations of iron sulfide, barium sulfate, strontium sulfide, calcite, biomass, paraffin, asphaltene, biofilm, completion fluids, workover fluids, gels, friction reducers, and the like. The composition may include various combinations of chlorine dioxide, acids, and other chemicals. The methods and systems may be used to re-stimulate, clean out, improve, or enhance production of petrochemical wells from which petrochemicals have previously been extracted. For instance, the methods and systems may be used to re-stimulate unconventional, multi-fractured horizontal, vertical, or inclined wells.

20 Claims, 14 Drawing Sheets

(56) References Cited

OTHER PUBLICATIONS

Logan W. D.; Dalamarinis P.; Williams B.; Urbis K.; Lipari S.: "An Industrialized Approach to Stage-by-Stage Completion Designs," URTeC: 2899869 presented at Unconventional Resources Technology Conference in Houston, Texas, USA, Jul. 23-25, 2018.

Dalamarinis P., Mueller P., Logan D., Glascock J., Broll S.: "Real-Time Hydraulic Fracture Optimization Based on the Integration of Fracture Diagnostics and Reservoir Geomechanics," URTeC: 2786 presented at Unconventional Resources Technology Conference, Austin, Texas, USA, Jul. 20-22, 2020.

Barba, R. E. (2015). Liquids Rich Organic Shale Recovery Factor Application. Presented at the SPE Annual Technical Conference and Exhibition. https://doi.org/10.2118/174994-MS.

DOE/National Energy Technology Laboratory, 2019, https://netl.doe.gov/sites/default/files/2019-04/Program-130.pdf.

Industry Struggles With Enhanced Recovery for Unconventional Reservoirs, J Pet Technol 71 (10): 57-58. Paper No. SPE-1019-0057-JPT.

Johannes O. Alvarez, Mohsen Tagavifar, Shashvat Doorwar, DT Vo2, Varadarajan Dwarakanath, Taimur Malik, Dengen Zhou, Jesse Strickle2, Lee (Rusty) Mathis.: "Design of Chemical EOR in Unconventional Reservoirs", URTeC: 3870505, Unconventional Resources Technology Conference, Denver, Colorado, USA, 2023.

I. Z. Ataceri, I. W. R. Saputra, A. R. Bagareddy, M. H. Elkady, D. S. Schechter, G.W. Haddix, V. A. Brock2, K. H. Raney, C. W. Strickland, G. R. Morris: Surfactant EOR Improves Oil Recovery in a Depleted Eagle Ford Unconventional Well—A Case Study, URTeC: 3831548, Unconventional Resources Technology Conference, Denver, Colorado, USA, 2023.

Shuler, P. J., Lu, Z., Ma, Q., & Tang, Y. (Apr. 11, 2016). Surfactant Huff-n-Puff Application Potentials for Unconventional Reservoirs. Presented at SPE Improved Oil Recovery Conference. https://doi.org/10.2118/179667-MS.

Radwan A.; Khosrow N.; Ramanathan R.: "Tailored Metal Oxide Nanoparticles-Based Fluids for Production Enhancement via Engineered Uplift Pressure Mechanism: Multi-Basin Case Studies," Paper presented at the SPE/AAPG/SEG Unconventional Resources Technology Conference, Houston, Texas, USA, Jun. 2022. doi: https://doi.org/10.15530/urtec-2022-3722922.

P. Dalamarinis, A. Radwan, Raja Ramanathan, Abdulaziz Ellafi, Suman Khanal: Tailored Metal Oxide Nanoparticles-Based Fluids in Acid Restimulation Treatments Reverses Long-Term Hydrocarbon Decline: A Pilot Study in Wolfcamp (A) Formation, ATCE 2023, SPE-215039-MS.

Ryan Pagel, Trey Tindall, Tom Pursley, Tim Sweeney, Zack Li, Tim Lathrop, Bob Sullivan, Greg Simpson: Reducing Backpressure and Enhancing Throughput of Saltwater Disposal Wells with Chlorine Dioxide and Complex Nano Fluids: Optimization and Case Studies, SPE-193629-MS, SPE International Conference on Oilfield Chemistry Galveston, Texas, USA, Apr. 8-9, 2019.

Zhou Zhang, Pengbo Zhou, Lifang Zhao, Jin Yang: "Experimental Study of the Impact of Chlorine Dioxide on the Permeability of High-Rank Contaminated Coal Reservoirs," ACS Omega, 2021.

J.F. McCafferty, E.W. Tate, D.A. Williams, Field Performance in the Practical Application of Chlorine Dioxide as a Stimulation Enhancement Fluid, SPE 20626, 1990 SPE Annual Technical Conference and Exhibition, New Orleans, LA.

Marlan W. Downey, Julie Garvin, RC Lagomarsino, David F. Nicklin., A Quick-look Determination of Oil-in-Place in Oil Shale Resource Plays.

George B. Asquith, Reservoir Producibility Index (RPI) From NMR Logs and the Analysis of Tight Oil Reservoirs, Unconventional Resources Technology Conference, Jul. 24-26, 2017 Austin, Texas, USA.

Economides M. J., Hill D., Ehlig—Economides, C., Zhu, D., Petroleum Production Systems, Second Edition, Chapter 13, 83 pages.

George B. Asquith and Charles R. Gibson, Basic well log analysis for geologists, 1982, Chapters 5-8, 127 pages.

George B. Asquith; Lance Drager; Souvick Saha, "A New Approach To Estimating Sw In Carbonate Reservoir," The Log Analyst, vol. 34, Issue 03, May 1993, 6 pages.

M.J. Economides, R. Oligney, P. Valco, Unified Fracture Design, 2002, Chapters 3-8, 136 pages.

M.J. Economides, T. Martin, Modern Fracturing, 2008, Chapter 4, 90 pages.

* cited by examiner

METHODS AND SYSTEMS FOR IMPROVING EXTRACTION OF PETROCHEMICALS FROM PETROCHEMICAL WELLS

CROSS-REFERENCE

The present application claims priority to U.S. Provisional Patent Application No. 63/753,102, entitled "METHODS AND SYSTEMS FOR IMPROVING EXTRACTION OF PETROCHEMICALS FROM PETROCHEMICAL WELLS," filed on Feb. 3, 2025, which is incorporated herein by reference in its entirety for all purposes.

BRIEF DESCRIPTION OF THE DRAWINGS

The accompanying drawings, which comprise a part of this specification, illustrate several embodiments and, together with the description, serve to explain certain principles and features of the disclosed embodiments. In the drawings (also referred to as "Figures" or "FIGS.").

DESCRIPTION

The present disclosure is not limited to particular methods and systems, which may, of course, vary. It is also to be understood that the terminology used herein is for the purpose of describing particular embodiments only, and is not intended to be limiting.

Unless defined otherwise, all technical and scientific terms used herein have the same meaning as commonly understood by one of ordinary skill in the art.

The present disclosure details methods and systems for improving extraction of petrochemicals from petrochemical wells in conventional or unconventional reservoirs. One exemplary inventive method detailed herein is shown in FIG. 1.

Figure 1:
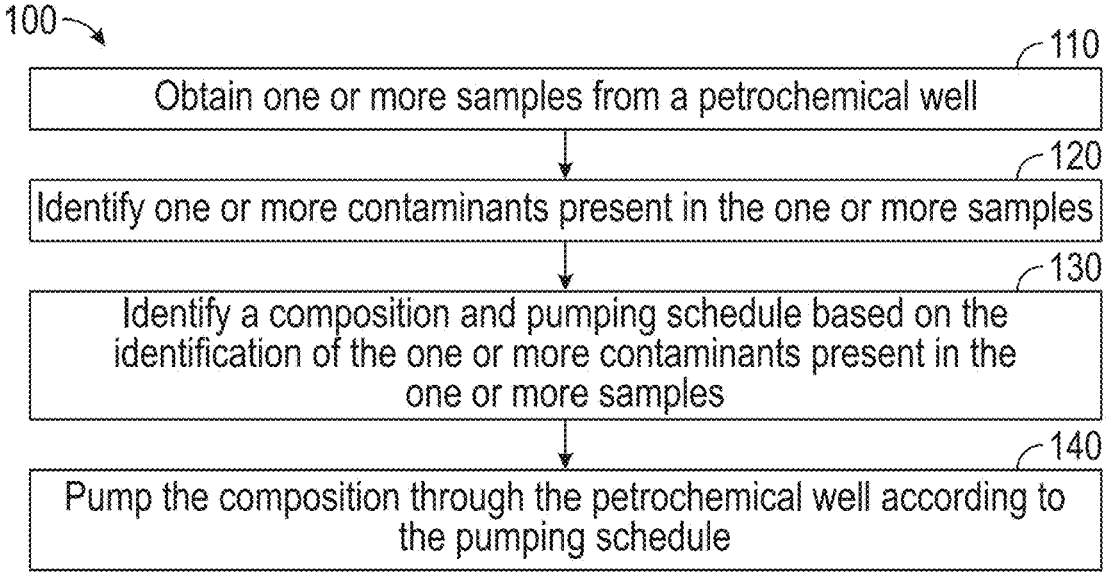
FIG. 1 shows a flowchart depicting a method for improving extraction of petrochemicals from petrochemical wells, in accordance with at least some embodiments.

FIG. 1 is a flowchart depicting a method 100 for improving extraction of petrochemicals from petrochemical wells. In at least some embodiments, the method 100 is used to re-stimulate, clean out, improve, or enhance production and recovery of petrochemical wells from which petrochemicals have previously been extracted. For instance, in at least some embodiments, the method 100 is used to re-stimulate unconventional, multi-fractured horizontal, vertical, or inclined wells.

At 110, one or more samples are obtained from a petrochemical well. In at least some embodiments, the one or more samples comprise one or more oil samples obtained from the petrochemical well. In at least some embodiments, the one or more samples comprise one or more water samples obtained from the petrochemical well. In at least some embodiments, the petrochemical well comprises an oil well. In at least some embodiments, the petrochemical well comprises a natural gas well.

At 120, one or more contaminants present in the one or more samples are identified. In at least some embodiments, the one or more contaminants comprise any possible combination of iron sulfide, barium sulfate, strontium sulfide, calcite, biomass, paraffin, asphaltene, biofilm, completion fluids, workover fluids, gels, friction reducers, and any combination thereof.

At 130, a composition and pumping schedule is identified based on the identification of the one or more contaminants present in the one or more samples. In at least some embodiments, the composition and pumping schedule is configured to remove the one or more contaminants from the petrochemical well.

In at least some embodiments, the composition comprises a mixture of acid and chlorine dioxide (ClO2). In at least some embodiments, the composition comprises the ClO2 at a concentration of at least about 10 ppm, 20 ppm, 30 ppm, 40 ppm, 50 ppm, 60 ppm, 70 ppm, 80 ppm, 90 ppm, 100 ppm, 200 ppm, 300 ppm, 400 ppm, 500 ppm, 600 ppm, 700 ppm, 800 ppm, 900 ppm, 1,000 ppm, 2,000 ppm, 3,000 ppm, 4,000 ppm, 5,000 ppm, 6,000 ppm, 7,000 ppm, 8,000 ppm, 9,000 ppm, 10,000 ppm, 11,000 ppm, 12,000 ppm, 13,000 ppm, 14,000 ppm, 15,000 ppm, 16,000 ppm, 17,000 ppm, 18,000 ppm, 19,000 ppm, 20,000 ppm, or more, at most about 20,000 ppm, 19,000 ppm, 18,000 ppm, 17,000 ppm, 16,000 ppm, 15,000 ppm, 14,000 ppm, 13,000 ppm, 12,000 ppm, 11,000 ppm, 10,000 ppm, 9,000 ppm, 8,000 ppm, 7,000 ppm, 6,000 ppm, 5,000 ppm, 4,000 ppm, 3,000 ppm, 2,000 ppm, 1,000 ppm, 900 ppm, 800 ppm, 700 ppm, 600 ppm, 500 ppm, 400 ppm, 300 ppm, 200 ppm, 100 ppm, 90 ppm, 80 ppm, 70 ppm, 60 ppm, 50 ppm, 40 ppm, 30 ppm, 20 ppm, 10 ppm, or less, or a concentration that is within a range defined by any two of the preceding values.

In at least some embodiments, the composition further comprises any possible combination of surfactants, nano surfactants, scale inhibitors, and diverters (chemical or mechanical).

In at least some embodiments, the composition further comprises any possible combination of dissolved nitrogen (N2) gas, carbon dioxide (CO2) gas, methane gas, ethane gas, propane gas, butane gas, and the like.

In at least some embodiments, the composition or the pumping schedule is determined based on a model. In at least some embodiments, the model incorporates information from any possible combination of geological zones contained within the petrochemical well, geochemical zones contained within the petrochemical well, a legacy of hydraulic fracturing pumping schedule within the petrochemical well, a legacy of perforation designs within the petrochemical well, a total number of completed stages within the petrochemical well, and a stimulated lateral length within the petrochemical well.

In at least some embodiments, the model is generated by: (a) identifying, based on at least one open hole log or at least one core sample from at least one pilot well drilled into the petrochemical well, a formation net pay height, a reservoir permeability, and a reservoir porosity associated with the petrochemical well; (b) determining, based on a proposed hydraulic fracturing schedule, a proppant pack permeability and a proppant pack porosity associated with the petrochemical well; (c) determining, based on (a) and (b), a proppant number, an optimum dimensionless fracture conductivity, and a maximum dimensionless productivity index; (d) determining, from the one or more samples, one or more scale tendencies associated with the petrochemical well; (e) determining, based on (d), one or more diffusivities of components of the composition in the petrochemical well; (f) determining a depth in fracture system or porous medium of the petrochemical well to which the composition should be pumped; and (g) determining, based on (c), (e), and (f), the composition or the pumping schedule.

In at least some embodiments, the proposed hydraulic fracturing schedule comprises one or more members selected from the group consisting of: a proposed fracturing fluid volume, a proposed proppant volume, a proposed hydraulic fracturing pumping rate, a proposed perforation scheme, and any combination thereof.

In at least some embodiments, the model is at least partially configured to simulate a chemical reaction between the one or more contaminants and the composition.

In at least some embodiments, the pumping schedule comprises instructions to pump a total volume of the composition through the petrochemical well. In at least some embodiments, the total volume is at least about 100 barrels (bbl), 150 bbl, 200 bbl, 250 bbl, 300 bbl, 350 bbl, 400 bbl, 450 bbl, 500 bbl, 550 bbl, 600 bbl, 650 bbl, 700 bbl, 750 bbl, 800 bbl, 850 bbl, 900 bbl, 950 bbl, 1,000 bbl, 1,500 bbl, 2,000 bbl, 2,500 bbl, 3,000 bbl, 3,500 bbl, 4,000 bbl, 4,500 bbl, 5,000 bbl, 5,500 bbl, 6,000 bbl, 6,500 bbl, 7,000 bbl, 7,500 bbl, 8,000 bbl, 8,500 bbl, 9,000 bbl, 9,500 bbl, 10,000 bbl, 11,000 bbl, 12,000 bbl, 13,000 bbl, 14,000 bbl, 15,000 bbl, 16,000 bbl, 17,000 bbl, 18,000 bbl, 19,000 bbl, 20,000 bbl, or more, at most about 20,000 bbl, 19,000 bbl, 18,000 bbl, 17,000 bbl, 16,000 bbl, 15,000 bbl, 14,000 bbl, 13,000 bbl, 12,000 bbl, 11,000 bbl, 10,000 bbl, 9,500 bbl, 9,000 bbl, 8,500 bbl, 8,000 bbl, 7,500 bbl, 7,000 bbl, 6,500 bbl, 6,000 bbl, 5,500 bbl, 5,000 bbl, 4,500 bbl, 4,000 bbl, 3,500 bbl, 3,000 bbl, 2,500 bbl, 2,000 bbl, 1,500 bbl, 1,000 bbl, 950 bbl, 900 bbl, 850 bbl, 800 bbl, 750 bbl, 700 bbl, 650 bbl, 600 bbl, 550 bbl, 500 bbl, 450 bbl, 400 bbl, 350 bbl, 300 bbl, 250 bbl, 200 bbl, 150 bbl, 100 bbl, or less, or within a range defined by any two of the preceding values.

In at least some embodiments, the pumping schedule comprises instructions to pump the composition through the petrochemical well for a period of time. In at least some embodiments, the period of time is at least about 0.5 hours, 1 hour, 1.5 hours, 2 hours, 2.5 hours, 3 hours, 3.5 hours, 4 hours, 4.5 hours, 5 hours, 5.5 hours, 6 hours, 6.5 hours, 7 hours, 7.5 hours, 8 hours, 8.5 hours, 9 hours, 9.5 hours, 10 hours, or more, at most about 10 hours, 9.5 hours, 9 hours, 8.5 hours, 8 hours, 7.5 hours, 7 hours, 6.5 hours, 6 hours, 5.5 hours, 5 hours, 4.5 hours, 4 hours, 3.5 hours, 3 hours, 2.5 hours, 2 hours, 1.5 hours, 1 hour, 0.5 hours, or less, or within a range defined by any two of the preceding values.

In at least some embodiments, the pumping schedule comprises instructions to pump the composition through the petrochemical well at a rate. In at least some embodiments, the rate is at least about 1 barrel per minute (bpm), 2 bpm, 3 bpm, 4 bpm, 5 bpm, 6 bpm, 7 bpm, 8 bpm, 9 bpm, 10 bpm, 11 bpm, 12 bpm, 13 bpm, 14 bpm, 15 bpm, 16 bpm, 17 bpm, 18 bpm, 19 bpm, 20 bpm, 21 bpm, 22 bpm, 23 bpm, 24 bpm, 25 bpm, 26 bpm, 27 bpm, 28 bpm, 29 bpm, 30 bpm, 31 bpm, 32 bpm, 33 bpm, 34 bpm, 35 bpm, 36 bpm, 37 bpm, 38 bpm, 39 bpm, 40 bpm, or more (e.g., a number of bpm at which the well was originally pumped), at most about 40 bpm, 39 bpm, 38 bpm, 37 bpm, 36 bpm, 35 bpm, 34 bpm, 33 bpm, 32 bpm, 31 bpm, 30 bpm, 29 bpm, 28 bpm, 27 bpm, 26 bpm, 25 bpm, 24 bpm, 23 bpm, 22 bpm, 21 bpm, 20 bpm, 19 bpm, 18 bpm, 17 bpm, 16 bpm, 15 bpm, 14 bpm, 13 bpm, 12 bpm, 11 bpm, 10 bpm, 9 bpm, 8 bpm, 7 bpm, 6 bpm, 5 bpm, 4 bpm, 3 bpm, 2 bpm, 1 bpm, or less, or within a range defined by any two of the preceding values. In some embodiments, the rate is based upon a pumping rate used when the petrochemical well was previously fractured (e.g., an upper limit of a pumping rate used when the petrochemical well was fractured for a first time).

At 140, the composition is pumped through the petrochemical well according to the pumping schedule. In at least some embodiments, pumping the composition through the well re-stimulates or cleans out the fracture system of the petrochemical well, permitting enhanced and improved recovery of petrochemicals from the petrochemical well.

Further described herein are systems (not shown in the Figures) configured to implement method 100, or any one or more of operations 110, 120, 130, and 140.

EXAMPLES

In conventional reservoirs secondary and tertiary oil recovery have been established methods to increase reserves and extend production life. In unconventional reservoirs with matrix permeability being as low as nano-Darcy, traditional enhanced and improved oil recovery (EOR/IOR) methods have to prove their technical, physical, and economic viability. A new EOR/IOR method which is used to improve injectivity in saltwater disposal (SWD) wells has been successfully applied in the Permian Basin resulting in production uplift and estimated ultimate recovery (EUR) increase.

The fracture system that is created during hydraulic fracturing operations is the subsurface pathway for the reservoir fluids to the wellbore. This pathway is subject to scale, paraffins, and biofilm depositions, as are surface flow lines and facilities. Engineered ClO2, a strong oxidizer capable of breaking down and keeping all these proppant pack contaminants in solution, was introduced as an EOR/restimulation agent. Reservoir pressure, volume, temperature (PVT) properties, scale tendencies, and production decline rates developed "fit for purpose" treatments ranging in volumes between 1,500-4,000 bbls of total fluid pumped into the wells.

In a first application of ClO2 for restimulation and EOR detailed by Dalamarinis, et al, 2023, wells at which a similar artificial lift system was installed demonstrated improved production between 70% to 300%. ClO2 treatments were pumped in the same wells multiple times over a three year period (with an average frequency of one year), and every time these wells were re-stimulated, production and Downhole Bottom Pressure were restored to the levels observed after the first treatment (as high as 80% when compared to the wells' initial production (IP) rates). Furthermore, the application of this Fracture-EOR (F-EOR) method was expanded in Reeves, Culberson, Pecos, and Martin Counties, with more than 60 treatments pumped in approximately 40 wells with oil gravities from as low as 300 to as high as 550 API, with similar success, proving its effectiveness in different environments. The production uplift that was achieved further validated the theory that production decline in unconventional wells is not related exclusively to reservoir depletion but to the skin damage effect developed inside the fracture system, resulting from scale, biofilm, paraffin, and asphaltene deposition, something that ClO2 can effectively remove from the near-wellbore area, thus restoring the reservoir/wellbore conductivity.

Production results demonstrate that significant production uplift can be achieved, sometimes >500%. With thousands of legacy wells in inventory, operators can mitigate production decline and deferment with ClO2 treatments, mitigating the need to constantly drill new wells to achieve production targets.

Thousands of unconventional oil and gas wells are drilled and completed in different shale plays every year in the continental US. One of the main characteristics of unconventional formations is the steep decline in production rates, often as high as 40%, in the first six months of production (Logan et al., 2018, Dalamarinis et al., 2020). This characteristic creates the need for continued drilling and completion for operators to sustain a field's production/cash flow.

Typical recoveries, from unconventional resources based on historical data and industry studies, usually do not exceed 10% (Barba, 2015, DOE, 2019, JPT 2019). To improve recovery and oil/gas production several methodologies and field trials of EOR, adjusted to the nature of these resources (low permeability/porosity), have been tested the last 10 years in hydraulically fractured wells (Alvarez et al, 2023, Ataceri et al, 2023). These EOR tests were either huff and puff (Shuler et al., 2016) or injection of water with chemicals, primarily surfactant (Alvarez et al, 2023, Ataceri et al, 2023), having as objective the alteration of the wettability of the fracture face/reservoir rock and the reduction of interfacial tension (IFT) and contact angle between oil and water, through surfactant inhibition (Alvarez et al, 2023, Ataceri et al, 2023, Radwan et al, 2022, Dalamarinis et al, 2023). Although production improvement was achieved, these treatments had four major disadvantages:

1) The wells had to shut-in for several weeks to a month to allow proper and effective soak/inhibition of the surfactants/chemicals.
2) The cost of these treatments is several hundred thousand or even more than one million dollars, without considering the revenue loss during the shut-in time for the chemical inhibition.
3) Injection times lasted up to several days.
4) The total volume injected into the fracture system of the test wells was >50,000 bbls of total fluid with chemicals, mainly surfactant.

Figure 2A:
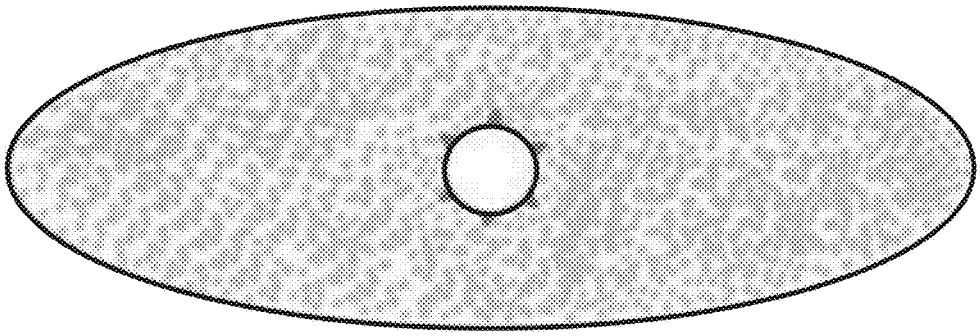
FIG. 2A depicts a representation of an exemplary fracture system before production, in accordance with at least some embodiments.
Figure 2B:
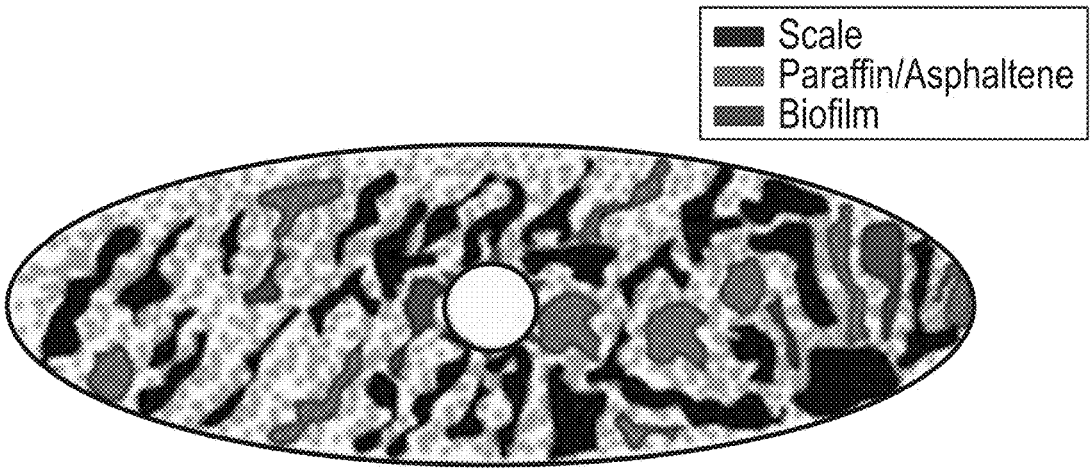
FIG. 2B depicts a representation of the fracture of FIG. 2A after scale, paraffin/asphaltene, and biofilm have been formed, in accordance with at least some embodiments.

A different theory, mitigation practice, and Fracture Clean Out-Enhanced Oil Recovery (F-EOR) methodology was presented in the Unconventional Resources Technology Conference (URTeC) 3818857 paper. Dalamarinis et al. presented the theory that production decline in unconventional wells is due to plugging mechanisms developed inside the proppant pack of the fracture system. Scales like iron sulfide, strontium-barium sulfide, and calcite, along with heavy hydrocarbons (such as asphaltene/paraffin) and biofilm, can create skin damage inside the fracture system, reducing the reservoir/wellbore conductivity and communication and impairing the fracture system's ability to deliver the reservoir fluids to the well. FIG. 2A depicts a representation of an exemplary fracture system before production. FIG. 2B depicts a representation of the fracture of FIG. 2A after scale, paraffin/asphaltene, and biofilm have been formed.

The solution that was proposed and field trialed in December of 2021 was a modified ClO2 restimulation treatment in a Delaware Wolfcamp A well in Reeves County (Well A-0). Similar treatments have historically and currently been pumped in Saltwater Disposal (SWD) wells to improve the well's injectivity and remove the skin damage caused in the injection/disposal zone from the produced water that is disposed in those zones (Pagel et al., 2019). Laboratory experiments showcased the effectiveness of ClO2 in removing those contaminants in coal-bed methane and shale cores and improving the effective permeability (McCafferty et al., 1993, Zhang et al., 2021), but no case was recorded/published of an effective field trial in multiple wells. Following the successful trial, more treatments were pumped in a total of 10 wells in Reeves/Culberson County, with significant production uplift and reservoir conductivity improvement results (Table 1).

TABLE 1

Increase in Bottom Hole Pressure (BHP) due to $ClO_2$/Acid Re-Stimulation (Dalamarinis et al, 2023)

| Well Number | Pre-$ClO_2$ BHP (psi) | Post-$ClO_2$ BHP (psi) | PSI Gain |
|---|---|---|---|
| 1 | 2,530 | 3,605 | 1,075 |
| 2 | 2,591 | 3,431 | 840 |
| 3 | 2,331 | 3,422 | 1,091 |
| 4-First Acid/$ClO_2$ restimulation | 1,920 | 3,183 | 1,262 |
| 4-Second Acid/$ClO_2$ restimulation | 2,764 | 3,310 | 546 |
| 5 | 2,421 | 3,193 | 772 |

TABLE 1-continued

Increase in Bottom Hole Pressure (BHP) due to $ClO_2$/Acid Re-Stimulation (Dalamarinis et al, 2023)

| Well Number | Pre-$ClO_2$ BHP (psi) | Post-$ClO_2$ BHP (psi) | PSI Gain |
|---|---|---|---|
| 6 | 799 | 2,869 | 2,070 |
| 7 | 2,056 | 3,175 | 1,118 |
| 8 | 1,860 | 3,351 | 1,490 |
| 9 | 1,107 | 2,644 | 1,537 |
| 10 | 1,534 | 2,611 | 1,077 |

Since the first ClO2 restimulation treatment, the program expanded in Reeves, Culberson, Pecos and Martin Counties and applied in more than 40 wells and 60 treatments. Promising results improving production (from 70% to 300%) and increasing EUR (Dalamarinis et. al, 2023) were recorded even at wells with uneconomic profiles, and some of them would be considered as Plug & Abandon (P&A) Candidates by industry standards.

A significant conclusion after evaluating the results of the ClO2 treatments was that this type of EOR method was effective in formations with different scale tendencies, and varying geological, reservoir, and PVT properties, therefore proving its effectiveness and versatility (Table 2).

TABLE 2

Reservoir, PVT & Fluid Properties of Wells/Formations at which $ClO_2$ has been used for Fracture System Clean Out-EOR.

| Area Designation | A | B | C |
|---|---|---|---|
| County | Reeves/Culberson | Pecos | Martin |
| Formations | Wolfcamp A & B | Wolfcamp A & B<br>3rd Bone Spring | Wolfcamp A<br>Lower Spraberry |
| Oil API | 50-55 | 35-4 | 35-42 |
| GOR (scf/bo) | 8,000-30,000 | 1,500-3,000 | 1,200-2,000 |
| Oil Cut (%) | 5 | 30 | 30-45 |
| Paraffin/Asphaltene | NO/NO | YES/NO | YES/YES |
| Scale | Iron/barium/strontium sulfide | Iron sulfide/barium sulfide | Iron sulfide |

In addition to wells with different reservoir/scale/fluid properties, ClO2 EOR treatments were pumped in with varying Artificial Lift Systems such as:

Electric Submersible Pumps,

Conventional Gas Lifts, or

Rod Pumps.

Wells that had been pumped off and could not be economically produced with any of the above Artificial Lift Systems.

The reason for this test was to prove whether the production uplift was achieved from effectively cleaning the fracture system as opposed to the use of an Artificial Lift System with more/better drawdown.

Multiple treatments were also pumped in the same wells over the last 3 years, successfully increasing production every time, improving EUR and extending economic life. Some of these cases will be presented herein, along with information regarding the reservoir response/basic evaluation, to better understand the scale-damaging mechanisms related to production loss and how to effectively remove them.

Figure 3:
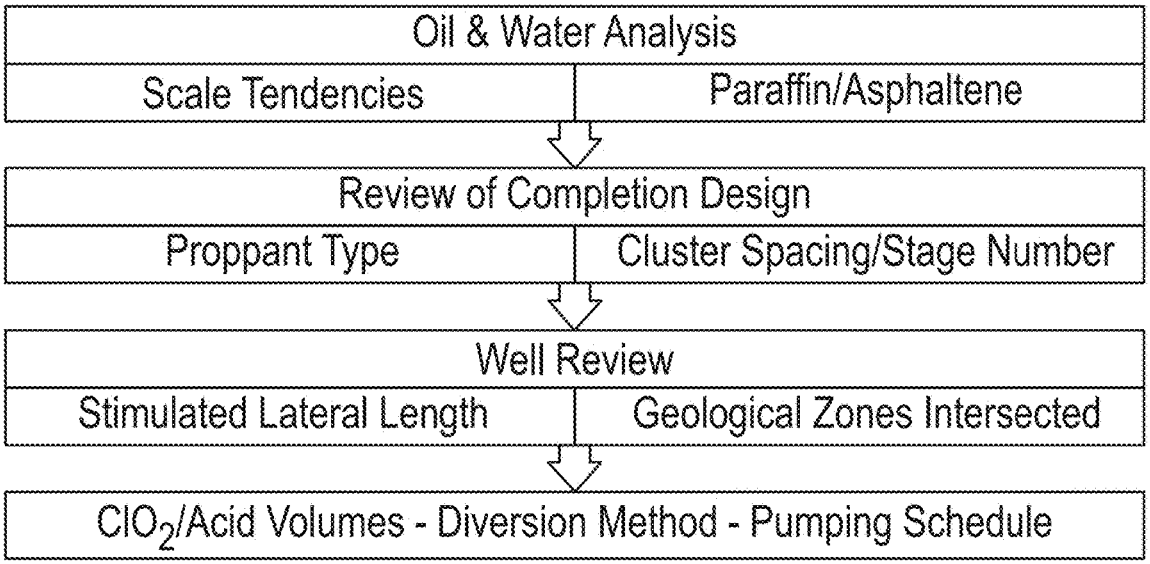
FIG. 3 shows an exemplary workflow to generate a chlorine dioxide ($ClO_2$) treatment, in accordance with at least some embodiments.

The first ClO2/acid EOR treatment pumped in Well A-0 in Reeves County in December 2021 went through several modifications to improve its efficiency and was further engineered to address different scale and fracture skin damage mechanisms (biofilm, depositions of asphaltene/paraffin). In the following paragraphs the workflow and design considerations for a well are presented (FIG. 3). FIG. 3 shows an exemplary workflow to generate a ClO2 treatment.

Figure 4:
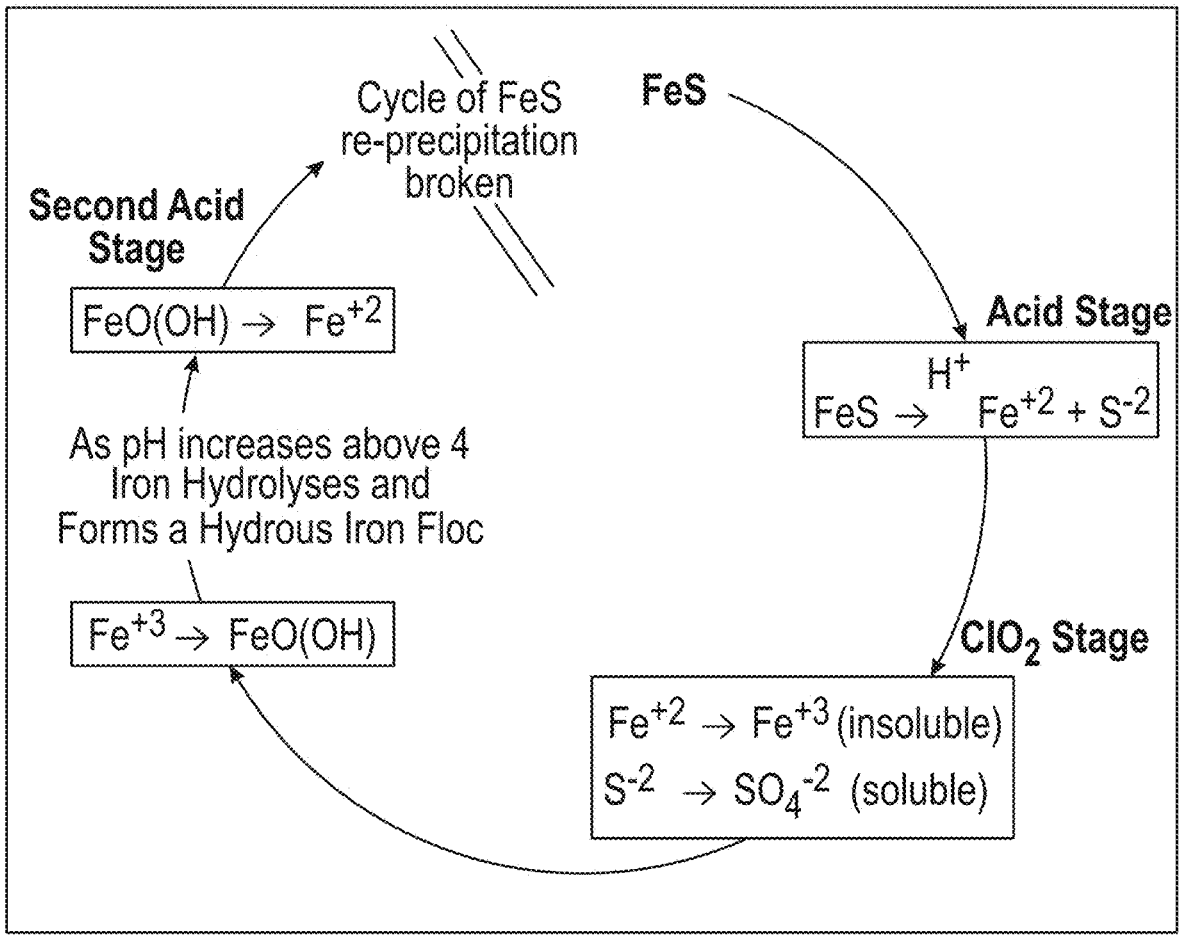
FIG. 4 shows an exemplary iron sulfide re-precipitation break down cycle, in accordance with at least some embodiments.

The first step for the design of ClO2/acid EOR treatments is to collect oil/water samples, analyze them and identify the type of minerals present in the produced formation water, and understand the scale tendencies associated with them. Iron sulfide, barium sulfate, strontium sulfide, and calcite scales require different combinations of ClO2/acid volumes/ratios/concentrations a) to break them down effectively, and b) to keep them in solution in the fluid inside the fracture system (FIG. 4), so they can be effectively flown back when the well will be brought online. In cases where biomass, paraffin, and asphaltene are present (Area B/C—Table 2), the treatments may be adjusted accordingly to effectively remove these fracture system contaminants. Field trials proved that an increase in ClO2 concentration to 4,000 ppm, in combination with tailored nano-surfactants, can effectively dissolve and remove these heavy hydrocarbons from the fracture system (Dalamarinis et al., 2023). FIG. 4 shows an exemplary iron sulfide re-precipitation break down cycle (Pagel et al., 2019).

The second step is the generation of an engineered ClO2/acid treatment, taking into consideration:

The geological/geochemical zones the well contains,

The legacy completion and perforation design (type of proppant, cluster number/spacing, fluid system), and The total number of completed stages and stimulated lateral length.

Once the treatment volumes are generated, the diversion method and strategy are designed. Table 3 shows the type of diversion methods that have been tested and their average diversion pressures that have been recorded/calculated from the pressure treatment data (Table 3).

TABLE 3

Different Diversion Methods and their Respective avg. Diversion Pressures Recorded

| Type of Diverter | Gel Acid | Rock Salt | Dissolvable Bio-balls |
|---|---|---|---|
| Average Diversion Pressure (psi) | 50-100 psi | 200-250 psi | 400-600 psi |

For most of the ClO2/acid treatments pumped (>90%), bio-balls have shown better diversion pressures, as shown in Table 3.

The final step of the design process is the generation of the pumping schedule. Throughout the jobs executed to date, the volume pumped has ranged from 1,500 to 4,000 bbls of total fluid, including in that a) ClO2/acid volume and b) volumes for spacers and diverter drops. Pumping time for these treatments has been between 1 hr to 2.5 hrs at rates of 15 to 32 barrels per minute (bpm).

Figure 5:
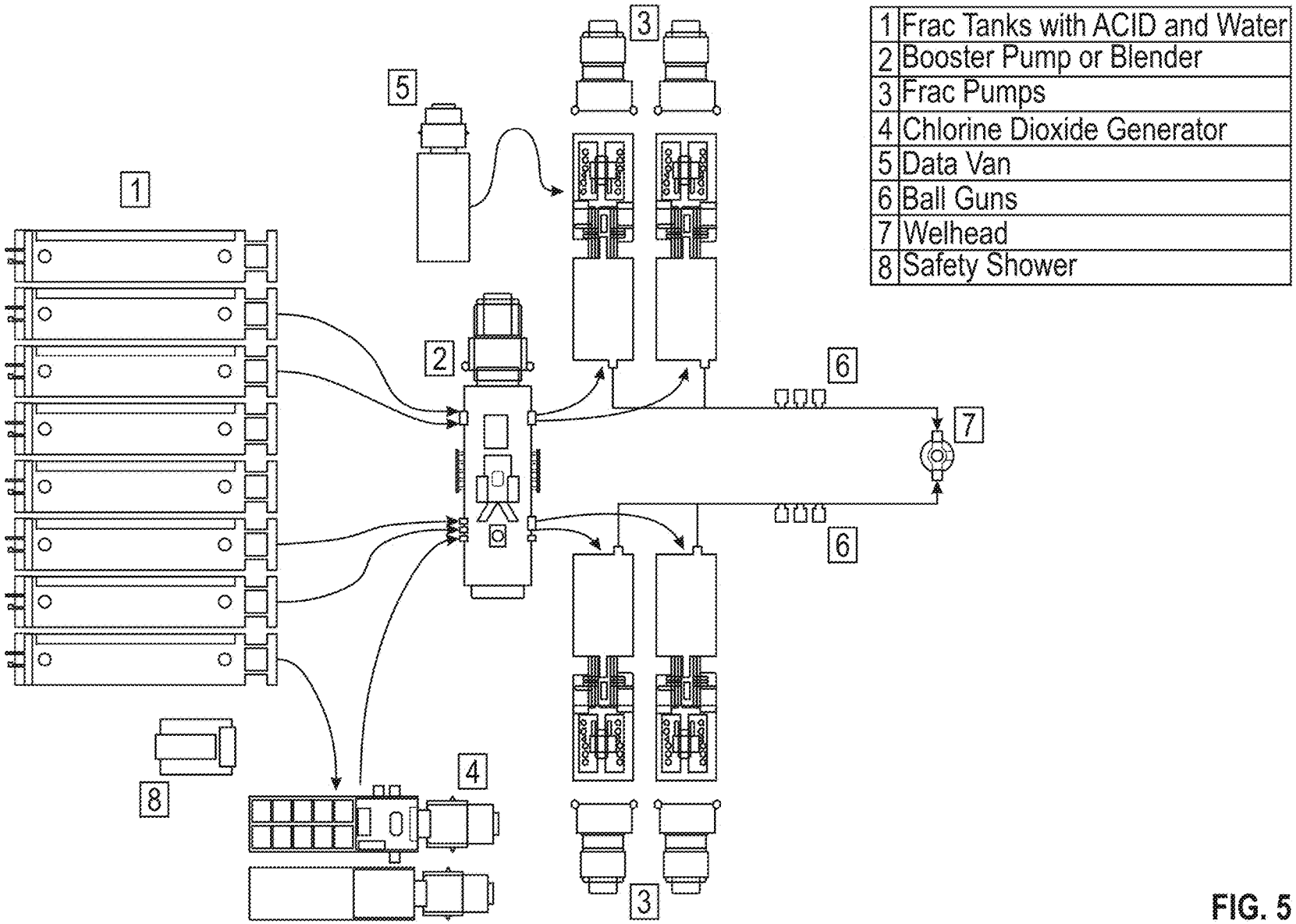
FIG. 5 shows an exemplary equipment layout for $ClO_2$ treatment, in accordance with at least some embodiments.

An exemplary typical equipment spread includes several frac pumps to achieve desired rates, equipment needed to generate amounts of ClO2 to match those rates, and tools for the deployment of diversion elements. Tailored nano-surfactants for every area are mixed in the water and acid tanks before starting to pump the ClO2 treatments (Dalamarinis et al., 2023). With the exception of the ClO2 generation pump and chemical trailers, these jobs do not differ when compared to a typical acid/chemical remediation job. FIG. 5 shows an exemplary equipment layout for ClO2 treatment (Source: Cudd).

Once the ClO2 treatment is executed and rig down of the pumping equipment is completed, the process of re-installing the artificial lift system may begin (ideally, as soon as practical). The combination of ClO2 with acid results in a fast scale/biofilm/heavy hydrocarbon breakdown reaction. ClO2 acts as an agent that can keep those contaminants (iron, sulfide, strontium, barium, biomass, paraffin, asphaltene, and the like) in solution in the fluid that is inside the fracture system, which is important for the flowback and clean-out process to start, ideally in less than 24 hours to 36 hours if possible. This is significantly less shut-in/inhibition time, when compared to other LOR methods in unconventional basins, proposed and field trialed by the industry in the last 10 years.

In the work by Dalamarinis, et al, 2023, data regarding the downhole reservoir pressure responses in different wells after ClO2 treatments were recorded and presented (Table 1), as were production uplift data. In the following, we further expand and present a) long-term production performance for some of these wells, b) uplift results in wells where ClO2 was pumped multiple times, and c) the results of those treatments for wells in Pecos (Area B—Table 2) and Martin Counties (Area C—Table 2).

Well A-0 was the first well where this new ClO2/acid Fracture-EOR method was trialed. This was a well Drilled and Completed (D&C) in July 2016 that had been producing with the help of a conventional gas lift system since 2017. In 2021, Well A-0 had become uneconomic due to high water cut (>98%) and the inability of the gas lift system to sufficiently draw down the reservoir where it could produce hydrocarbons in economic volumes (for most of 2021, the well was producing only water). Well A-0 was considered a P&A candidate at that time.

Review of oil and water analysis for this well indicated the existence of iron sulfide and barium sulfate scale tendencies. This information was taken into consideration, and Well A-0 was chosen as the first candidate to evaluate the theory that the production decline experienced in wells in unconventional resources is not because of reservoir depletion (common industry belief), but because the fracture system has been plugged with scale.

Figure 6:
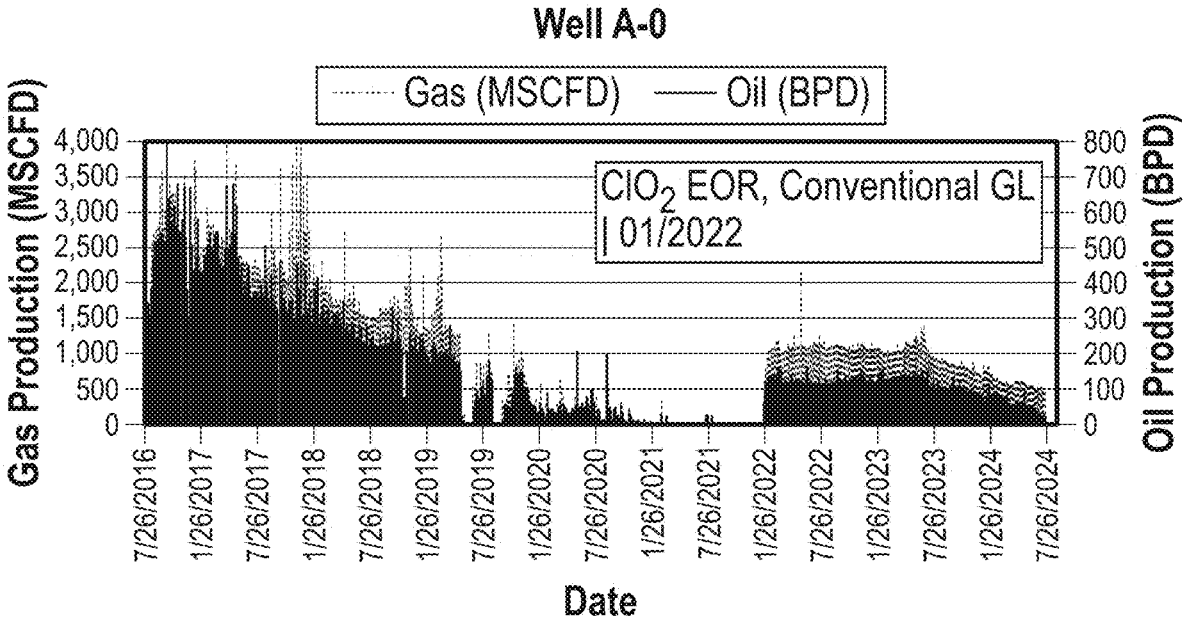
FIG. 6 shows an exemplary production performance and uplift of Well A-0 after ClO2 treatment, in accordance with at least some embodiments.
Figure 7:
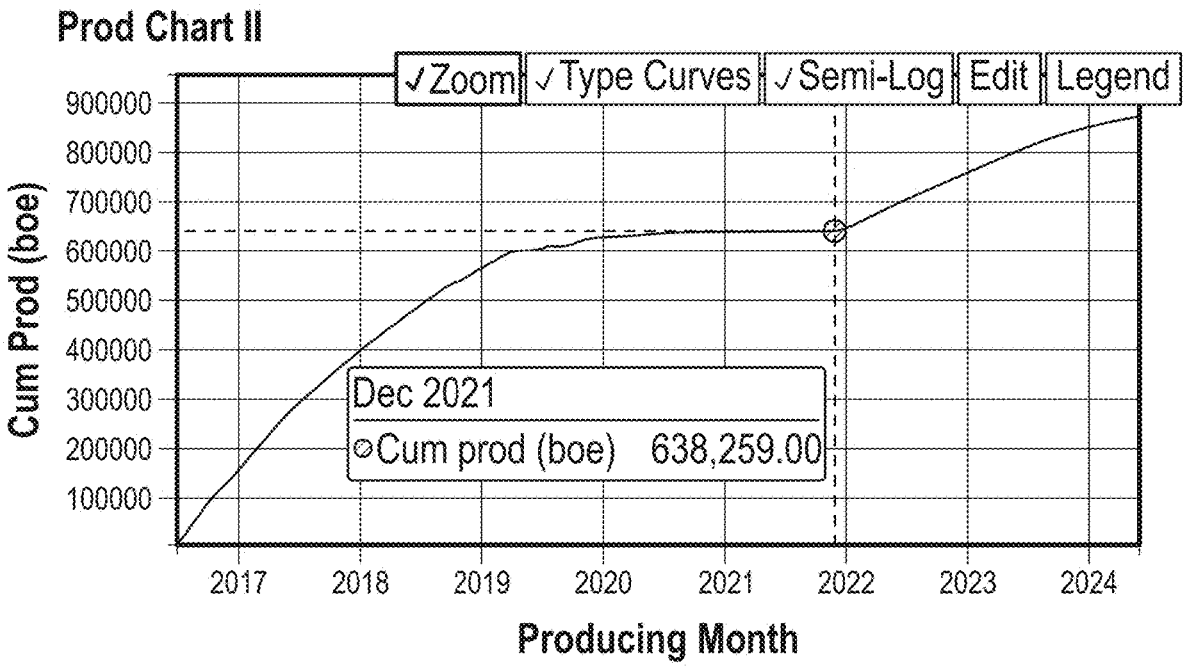
FIG. 7 shows an exemplary cumulative production of Well A-0 before and after ClO2 treatment, in accordance with at least some embodiments.
Figure 8:
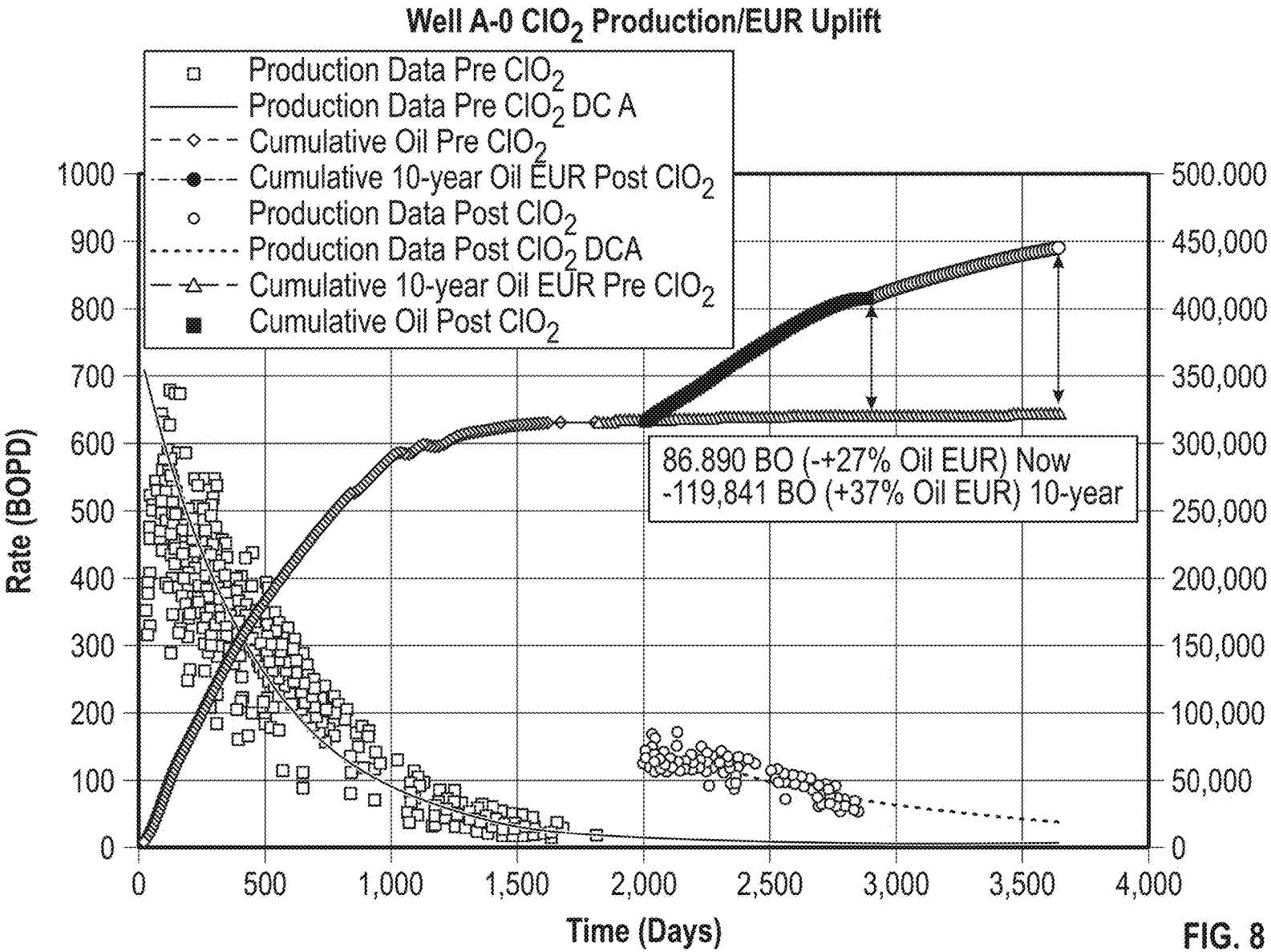
FIG. 8 shows an exemplary production data analysis (PDA) for Well A-0, in accordance with at least some embodiments.

A treatment was designed following the steps described in FIG. 3 and pumped. Immediately after the execution of ClO2/acid Fracture-EOR treatment, workover operations continued with the installation of a similar to the legacy gas lift system (number of valves/depth of valves). The well has been in production since December 2021 with no changes in the lift system or other chemical treatments pumped to it. The production profile and production/EUR uplift of Well A-0 are shown in FIGS. 6 and 7 and Table 4. Oil and gas production increased from 0 to ~125 bopd and 980 Mscfd. The cumulative production of the well in terms of barrel of oil equivalent (BOE)/recovery was increased from ~623 MBOE to 870 MBOE as of June 2024, an increase of almost 40%, 10-year Oil EUR increased ~120 MBO (+37%) based on Production Decline Analysis (FIG. 8).

TABLE 4

Production Performance and Uplift of Well A-0 after $ClO_2$ treatment

| | Pre-$ClO_2$ | Post-$ClO_2$ |
|---|---|---|
| Oil Production (bpd-30 days) | 0 | 125 |
| Gas Production (Mscf-30 days) | 0 | 950 |
| Cumulative Production (BOE) | 623,259 | 870,195 |
| 10-year Oil EUR | 321,640 | 445,695 |

FIG. 6 shows an exemplary production performance and uplift of Well A-0 after ClO2 treatment. FIG. 7 shows an exemplary cumulative production of Well A-0 before and after ClO2 treatment (Source Enverus—Public Data). FIG. 8 shows an exemplary production data analysis (PDA) for Well A-0.

Production uplift and BHP pressure response after pumping the ClO2 treatment indicated that the connection/conductivity with part of the reservoir had been restored. To gain an equally important understanding of this production response from a reservoir point of view, an analysis of Production versus Material Balance Time (MBT) was performed (Economides et al.), and the results of production vs. MBT are shown in FIG. 9.

Figure 9:
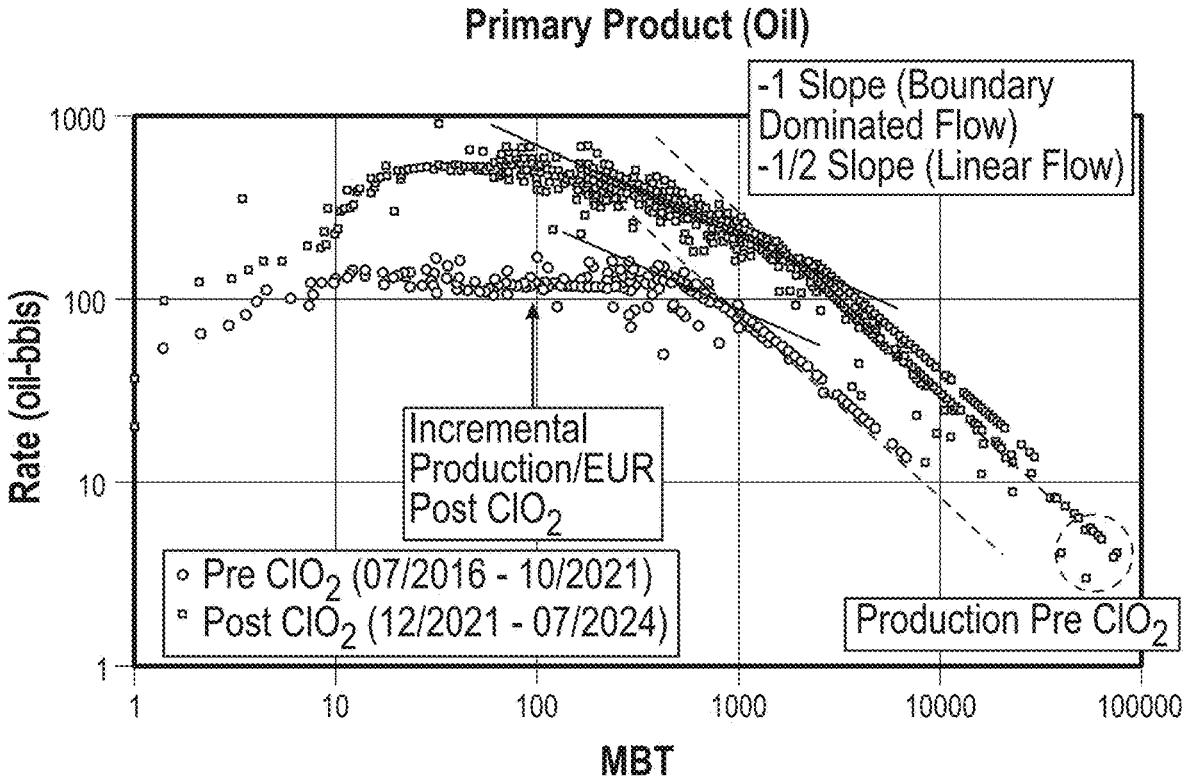
FIG. 9 shows an exemplary production vs. material balance time (MBT) for Well A-0, in accordance with at least some embodiments.

FIG. 9 shows an exemplary Production vs MBT of the primary product (oil) for Well A-0 from early flowback until October 2021 and the Production vs MBT of the primary product (oil) for Well A-0 after the ClO2 treatment pumped until July 2024. Linear and Boundary Dominated Flow can be observed for the period between 2016-2020. After the treatment with ClO2 in December 2021, we can identify in the Production vs MBT plot (FIG. 9) a new Linear Flow Regime before the production of the well transitioned to a Boundary Dominated flow for a second time. This behavior supported the assumption that the decline in production between 2016-2020 was not exclusively related to reservoir depletion, but also to skin damage mechanisms developed inside the fracture proppant system reducing the reservoir/wellbore connection and conductivity, which were significantly reduced. This behavior in production vs reservoir has been observed in about 60-70% of the wells at which ClO2 has been pumped.

The first 20 ClO2 treatments resulted in encouraging production uplift and reservoir response. They also acted as proof of concept that a simple, yet effective new EOR approach executed in just a few hours can provide superior results as compared to other EOR applications results trialed by the industry. While encouraging results were recorded in every well in which these treatments were applied, one question was if similar uplift could be achieved multiple times, extending the economic life of a well and increasing the total hydrocarbons recovered. Two wells at which two ClO2 treatments have been pumped will be discussed.

Well A-10 is a Wolfcamp A well in Reeves County (Table 2). The first ClO2 treatment was pumped in February 2022, after the evaluation of the production uplift results in Well A-0. Oil and gas production after the first treatment was increased from 90 to 187 bopd and 980 to 1,545 Mscfd, respectively. The well was in production for 15 months, and a second ClO2 EOR treatment was pumped. Oil and gas production after the second treatment increased from 60 to 125 bopd and 830 to 1,540 Mscfd. Both treatments successfully increased oil production >100% (Table 5). Downhole reservoir pressure increased both times as recorded from downhole ESP sensors (consistent designs) and presented in Table 5. Based on PDA (FIG. 10), Oil EUR increased from −273 MBO to 395 MBO, an increase of ~48% (Table 5—FIG. 10).

Figure 11:
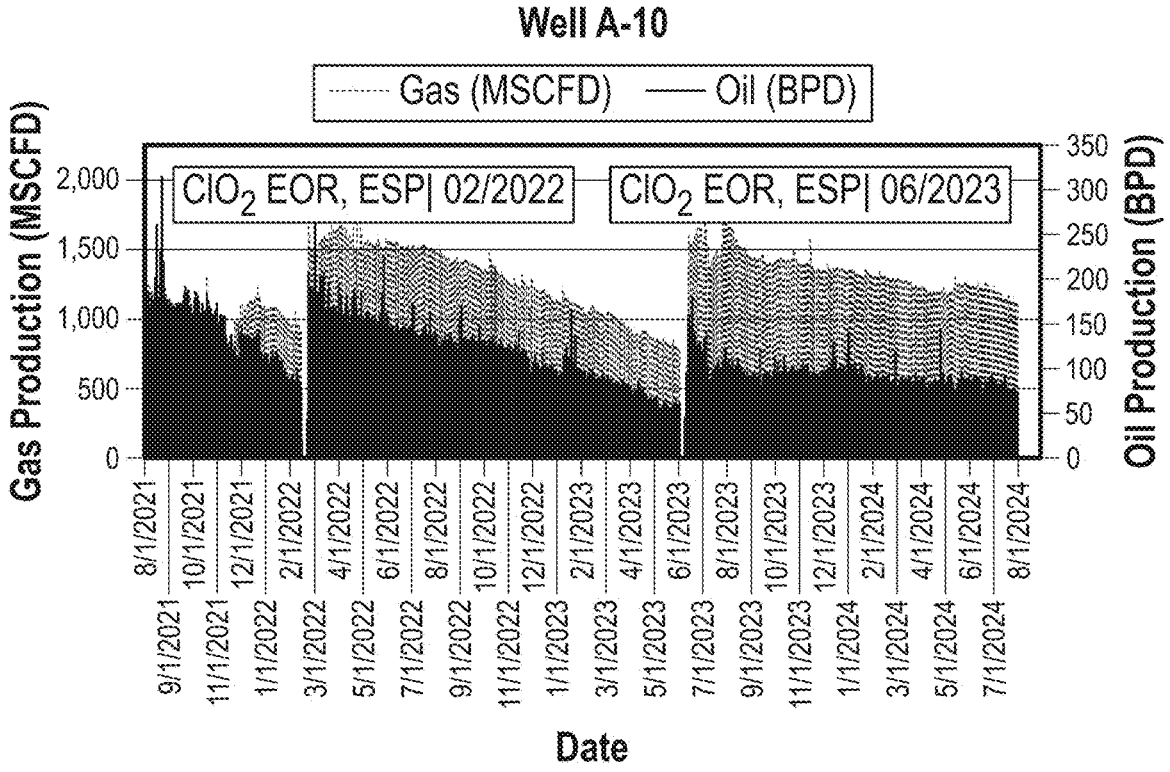
FIG. 11 shows an exemplary production performance and uplift of Well A-10 after two ClO2 treatments, in accordance with at least some embodiments.

Worth noting is the production decline behavior of Well A-10 after the second ClO2 EOR treatment. Oil and gas 12-month production decline is less for the same period when compared to the production decline after the first ClO2 treatment (FIG. 11). The improved production decline has been observed in multiple wells where a second treatment has been pumped, a promising behavior that can reduce the frequency of EOR treatments and the economic production profile of a well.

TABLE 5

Production Performance and Uplift of Well A-10 after $ClO_2$ treatments

| | Pre-$ClO_2$ | First $ClO_2$ | Second $ClO_2$ | |
|---|---|---|---|---|
| Date | — | February 2022 | June 2023 | |
| Oil Production (bpd-30 days) | 90 | 187 | Pre-60 | Post-125 |
| Gas Production (Mscf-30 days) | 980 | 1,545 | Pre-830 | Post-1,540 |
| BHP (psi) | 1,534 | 2,611 | 1,207 | 2,050 |
| 10-Year Oil EUR | ~273,600 | ~305,500 | ~395,000 | |
| 12-Month BOE Decline | — | ~40% | ~23% | |

Figure 10:
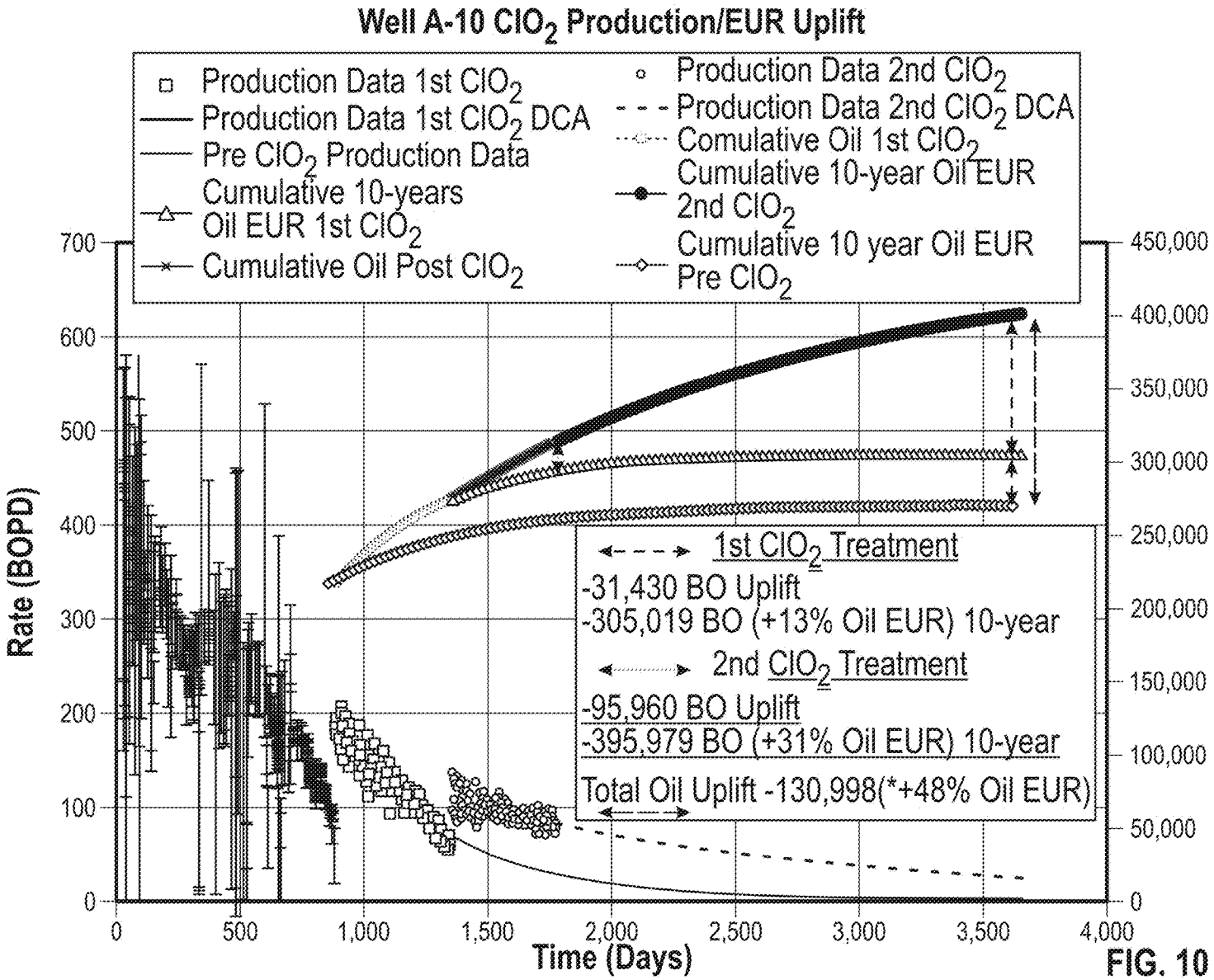
FIG. 10 shows an exemplary PDA and oil EUR uplift for Well A-10, in accordance with at least some embodiments.
Figure 12:
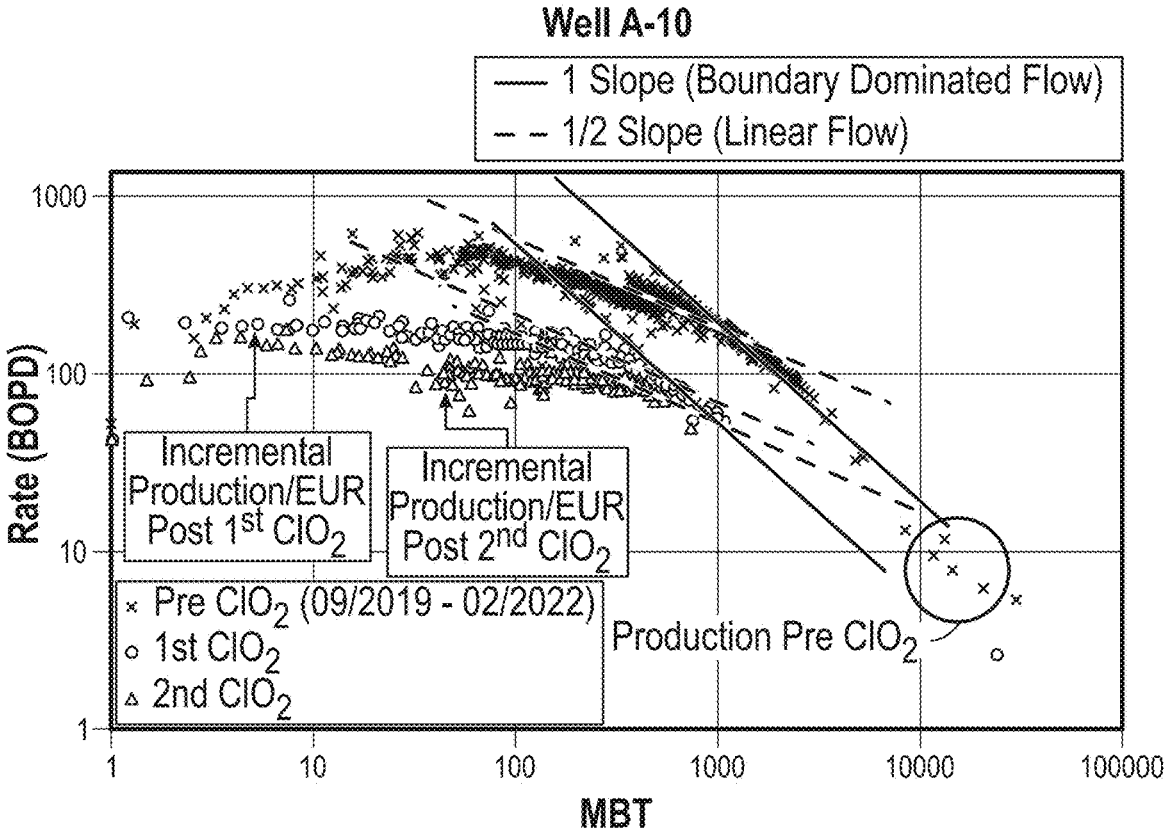
FIG. 12 shows an exemplary production vs MBT for Well A-10, in accordance with at least some embodiments.

FIG. 10 shows an exemplary PDA and oil EUR uplift for Well A-10. FIG. 11 shows an exemplary production performance and uplift of Well A-10 after two ClO2 treatments. FIG. 12 shows an exemplary production vs MBT for Well A-10.

Production vs MBT of the primary product (oil) for Well A-10 from early flowback until July 2024 demonstrated similarities to Well A-0's behavior after both ClO2 treatments (FIG. 12), with Linear and Boundary Dominated Flow Regimes.

Figure 13:
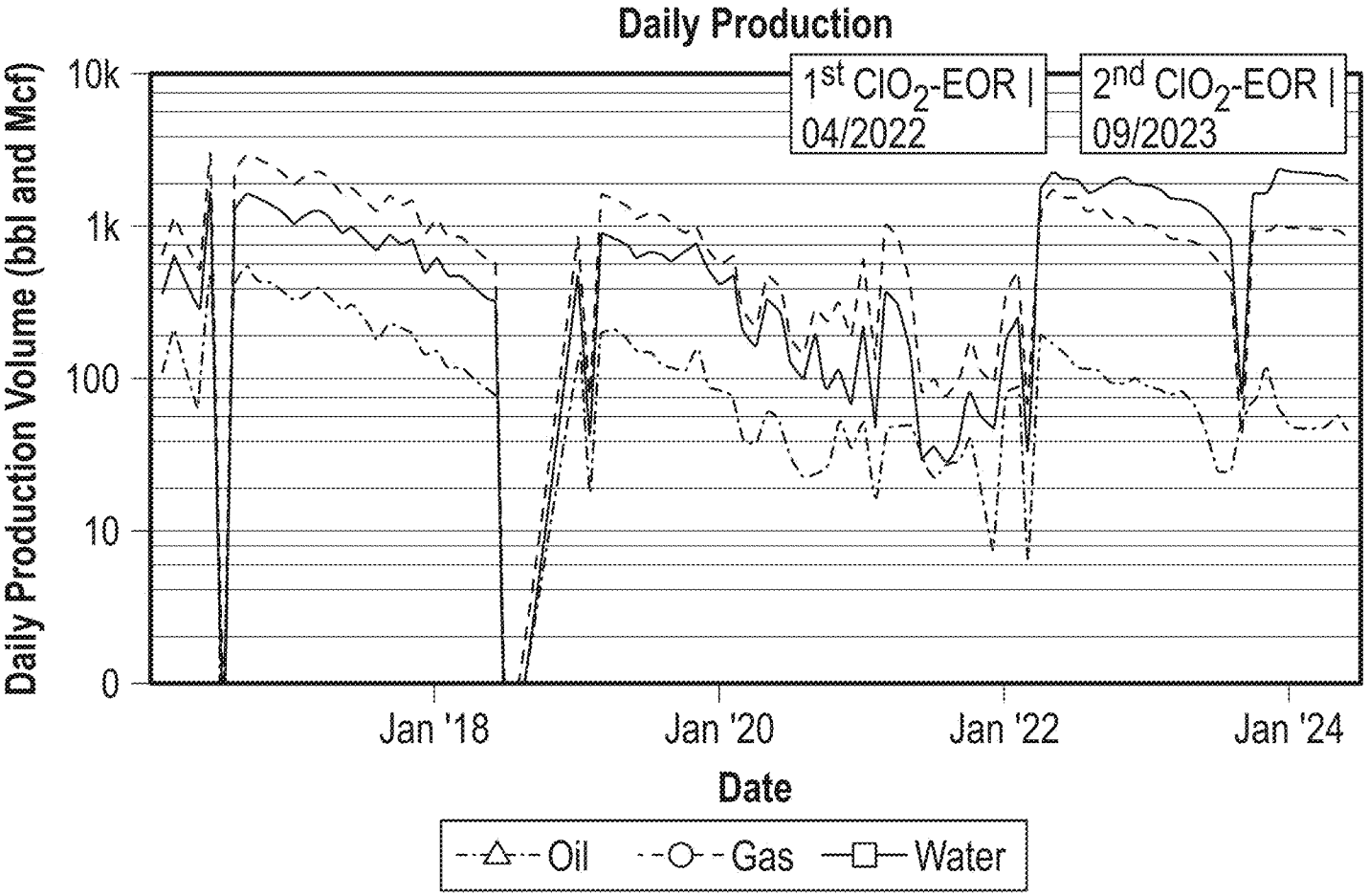
FIG. 13 shows an exemplary production performance and uplift of Well A-8 after two ClO2 treatments, in accordance with at least some embodiments.

Approximately 5 miles north-east of Well A-10 is located well A-8, another Wolfcamp A well with similar reservoir and production fluid characteristics. Two ClO2 treatments were pumped at this well, the first in April 2022 and the second in September 2023. As can be observed in FIG. 12, similar to well A-10, after the second ClO2 treatment, well A-8 achieved not only an uplift in production, but also an improved production decline profile. FIG. 13 shows an exemplary production performance and uplift of Well A-8 after two ClO2 treatments (Source Enverus—Public Data).

Figure 14:
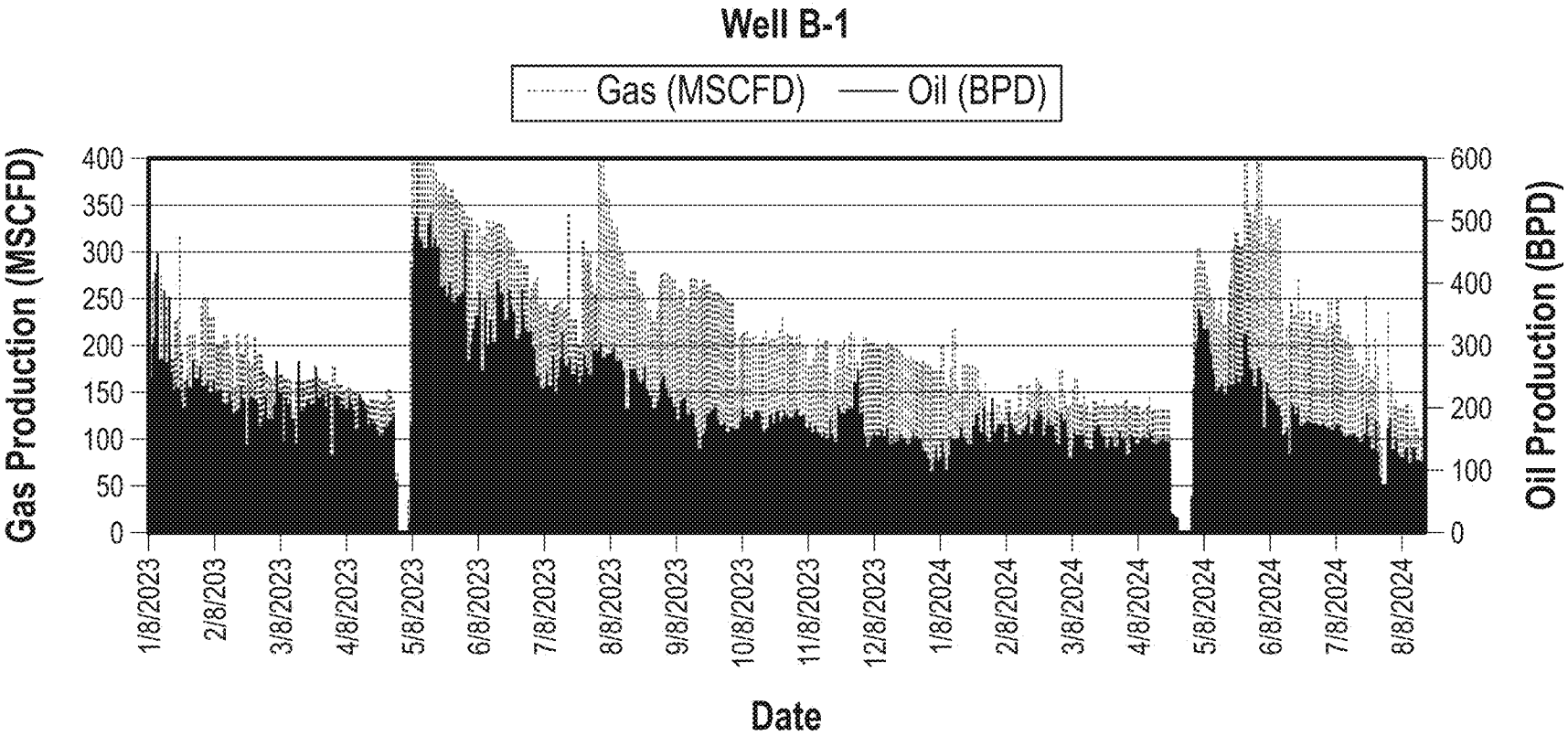
FIG. 14 shows an exemplary production performance and uplift of Well B-1 after ClO2 treatments, in accordance with at least some embodiments.

Due to the successful and encouraging results of the ClO2 F-EOR treatments, the program extended in a second field, with Well B-1 (Wolfcamp B) in Pecos County (Table 2) being the first candidate at which ClO2 EOR was tested in lower API gravity oil window zone. The well was D&C in May 2022 and was put on production with an ESP system. A year after the first installed ESP needed replacement, a ClO2 treatment was engineered to address the scale and paraffin tendencies the wells have in the area and executed in May 2023. The objective was to evaluate whether similar performance uplift results that were observed in Area 1 could be replicated in this part of the Delaware Basin (different reservoir, hydrocarbons, scale and PVT properties—Table 2). FIG. 14 shows an exemplary production performance and uplift of Well B-1 after ClO2 treatments.

Oil and gas production after the first treatment increased from 180 to 400 bopd. The well produced for 12 months, and, subsequently, a second ClO2 EUR treatment was pumped. Oil production after the second treatment increased from −145 to 225 bopd. The first ClO2 treatment increased the oil production ~110%, while the second increased oil production by ~85% (FIG. 14). After the first ClO2 treatment, the first 30 days of cumulative oil uplift resulted in an additional production of 6,600 bbls of oil. In addition to the production uplift, static BHP based on ESP sensor's data after the ClO2 treatment increased from −975 pounds per square inch (psi) to 3,580 psi, an increase of ~2,600 psi.

After the second ClO2 treatment in May 2024, during the first 30 days of production an additional ~3,500 bbls of oil was recovered. Until September of 2024, the oil production was higher by ~20 bopd compared with the well's production before May 2024 (FIG. 14). Results from PDA indicated an increase in 5-year oil EUR of ~57,600 barrels of oil (~25% compared to production/EUR expectations before the ClO2 treatments). Static BHP pressure increased from ~1,210 psi to ~2,700 psi. ClO2 proved its efficiency, successfully cleaned out the fracture system, and restored production and conductivity to reservoir for wells in Pecos County (Table 2—Area B).

Figure 15:
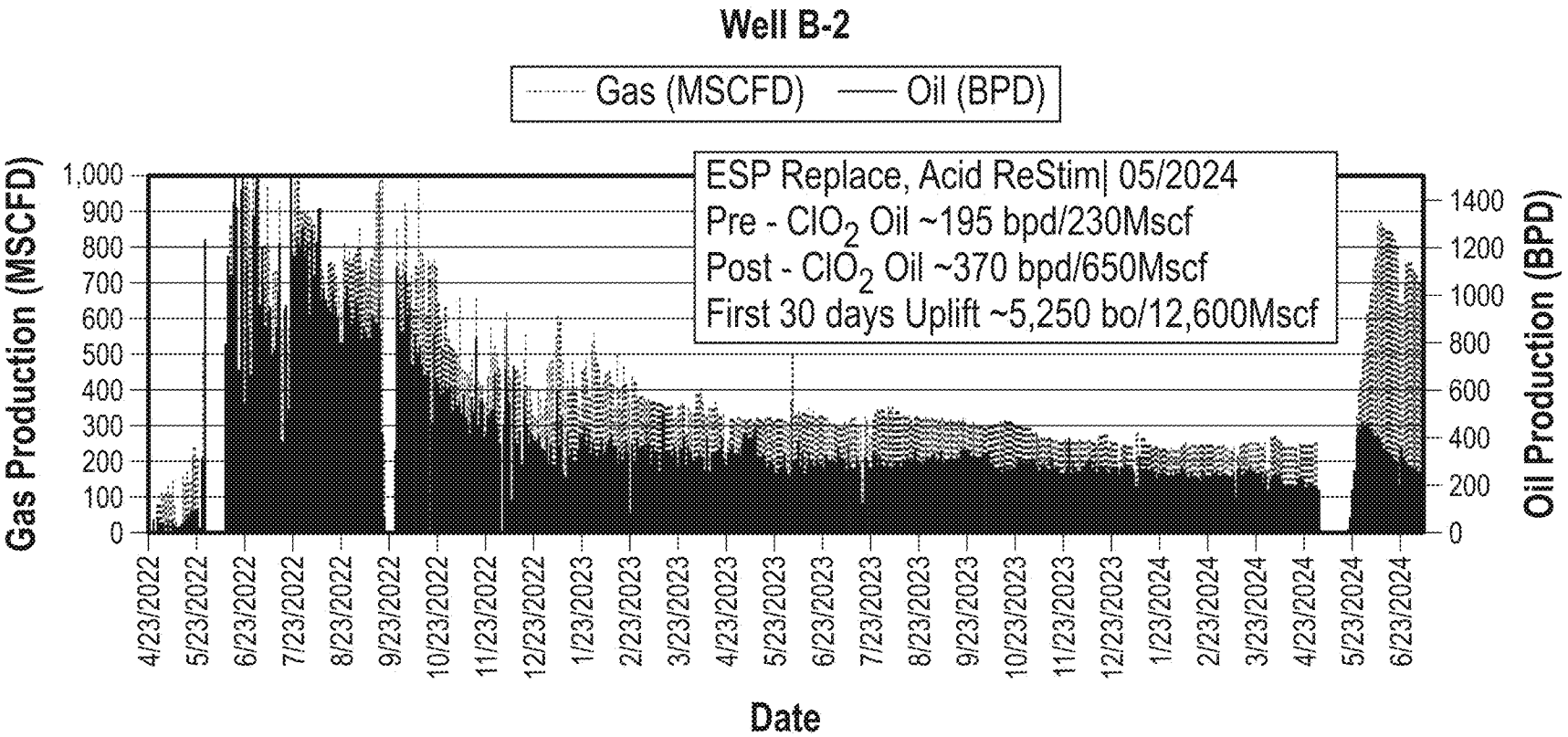
FIG. 15 shows an exemplary production performance and uplift of Well B-2 after ClO2 treatment, in accordance with at least some embodiments.

An offset to Well B-1, drilled and completed in the same pad and targeting the same zone, Well B-2 has been in production since May of 2022. In May 2024, the ESP in the well needed replacement. This well was also treated with ClO2 to enhance production. Oil production increased from ~195 to 370 bopd (FIG. 15). FIG. 15 shows an exemplary production performance and uplift of Well B-2 after ClO2 treatment.

An interesting observation after Well B-2 came online was the behavior of gas production. Gas increased from ~230 Mscfd to ~650 Mscfd, an increase of ~180%. In addition to this, the gas production after the ClO2 treatment was ~70% greater when compared to the well's initial gas production. Further evaluation of mud logs of Well B-2 indicated the existence of two high gas content reservoir zones. A possible explanation for this uplift in gas production could be that those two zones had been isolated from the wellbore due to scale/biofilm or gel from the fracturing fluid system, something that ClO2 managed to effectively break down and remove from the fracture system, resulting in the realized uplift in gas production.

Figure 16:
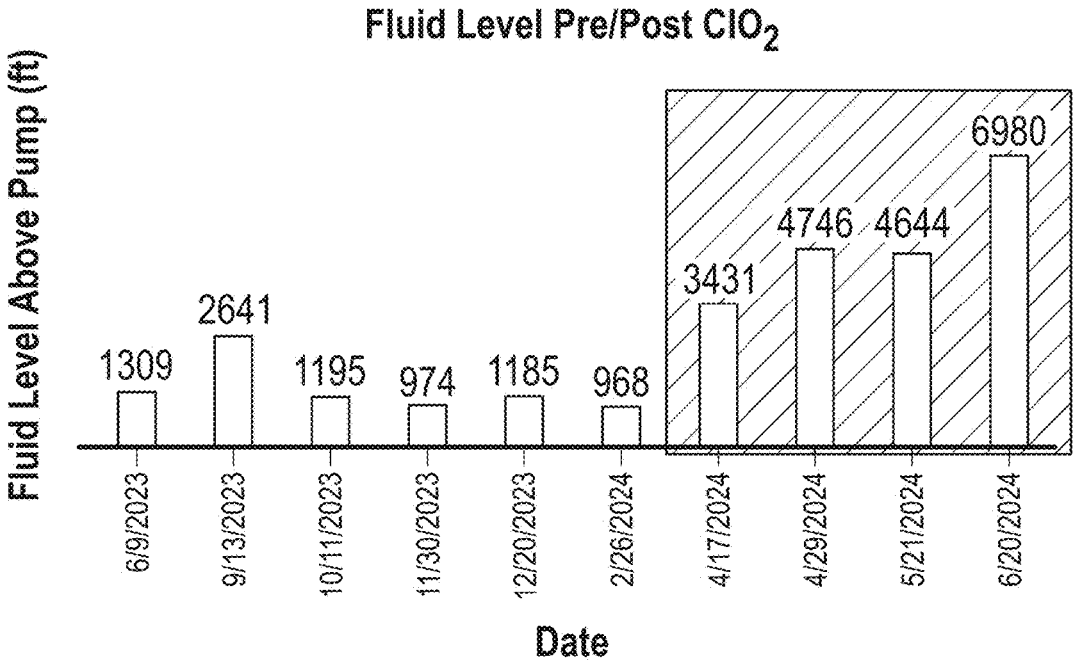
FIG. 16 shows an exemplary fluid level above the pump (FLAP) for Well B-3, in accordance with at least some embodiments.

Well B-3 is a Wolfcamp A well in Area B, D&C in 2019. The well was producing with the help of a Rod Pump with an average ~1,100 ft of fluid level above the pump (FLAP), based on fluid level data that were collected with fluid level shots (FIG. 16). In April 2024, due to a failure at the rod/pump system, an opportunity was presented to test the effectiveness of the ClO2 treatments in wells that are at late production phase (defined as depleted with Artificial Lift System moving <200 bbls of total fluid per day).

A ClO2 EOR treatment was designed, taking in consideration the scale and paraffin tendencies, and pumped. The failed rod/pump system was replaced with a similar one, and the well was put back on production. Oil and gas production increased from 70 to 158 bopd and 98 to 160 Mscfd. The first 90 days of cumulative oil uplift after the first ClO2 treatment resulted in an additional 4,650 bbls of oil and 22,900 Mscf of Gas (FIG. 17) compared to pre-treatment production. After the treatment, fluid level shots were collected to evaluate the production uplift in relation to the reservoir response. Fluid level after the treatment and before the new pump started lifting fluid increased from ~1,100 ft to 3,431 ft above the pump. As production operations continued and the well continued to clean up after the ClO2 treatment, fluid level further increased to 6,980 ft above the pump, an increase of ~5,880 ft (or an equivalent of ~2,600 psi reservoir pressure gain at the pump level—FIG. 16). Similar to Well B-2, after ~1.5 months of production, a significant increase in gas production was recorded (~310% when compared to pre ClO2 levels—FIG. 17). This can be attributed, like in the case of Well B-2, to high gas content reservoir zones that re-established conductivity/communication with the wellbore because of the ClO2 fracture system clean out.

Figure 17:
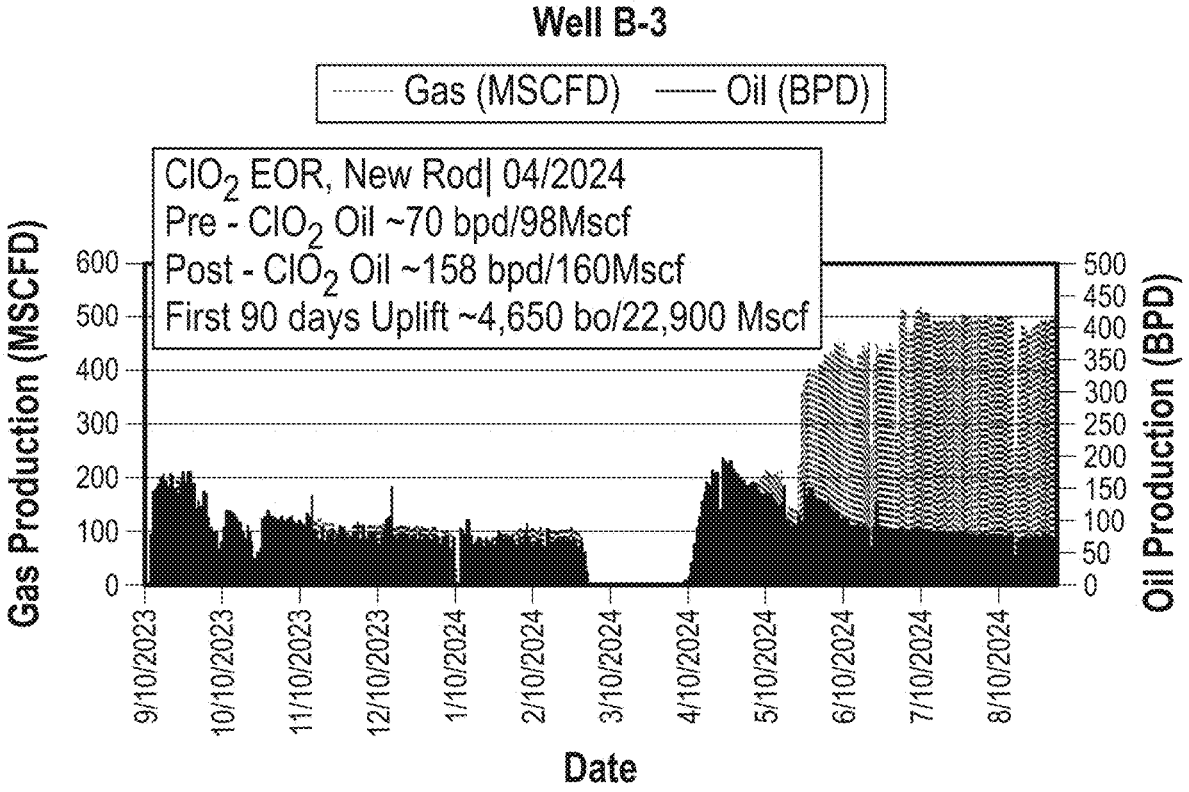
FIG. 17 shows an exemplary production performance and uplift of Well B-3 (Rod Lift) after $ClO_2$ treatment, in accordance with at least some embodiments.

ClO2/acid Fracture-EOR treatment effectively managed to restore fracture system communication and reservoir conductivity to Well B-3, a well that otherwise would have been considered a case for limited production and EUR uplift. Currently, Artificial Lift improvement options for this well are being evaluated to more effectively manage it and to obtain the full production improvement potential enabled by ClO2 treatment. FIG. 16 shows an exemplary FLAP for Well B-3. The highlighted box shows the increased FLAP after ClO2 Treatment. FIG. 17 shows an exemplary production performance and uplift of Well B-3 (Rod Lift) after ClO2 treatment.

Well B-4 is a Wolfcamp A well in Area B, D&C in 2017. The well, which was converted to rod lift and was pumped off, was capable of producing ~45 bbls of total fluid per day, 20 bbls of which was oil. The well was treated with ClO2. After treatment, its fluid level rose to −200 feet from the surface, demonstrating a significant improvement in re-establishing communication with the reservoir. A 1250 series Electrical Submersible Pump was run. After the treatment, the oil IP30 of Well B-4 averaged ~300 bbls of oil per day, an increase of 1,500% when compared to the previous well deliverability (FIG. 17). In the ~3 months after the ClO2 treatment, Well B-4 had produced ~17,000 bo & 35M Mscf, an equivalent of 850 days of Rod Pump performance production. From 2017 until May 2023, when the ClO2 treatment was pumped, the well had produced 193,988 bbls of oil and 289,406 Mscf of gas. Given the low rates of the well, it was considered to have limited ability to increase production. After the treatment, until August 2024, the well has produced a cumulative of 223,929 bbls of oil and 410,152 Mscf of gas, an increase in recovery of ~15% in oil and ~42% in gas (Table 6). To this day, the well is producing ~50 bopd and ~400 Mscfd.

TABLE 6

Production Performance and Uplift of Well B-4 after $ClO_2$ treatment
Well B-4 $ClO_2$ EOR Results

| Production | Oil (bpd) | Gas (Mscfd) | Total Cum. Oil (bbls) | Total Cum. Gas (Mscf) |
|---|---|---|---|---|
| Pre-$ClO_2$ (30 days) | ~20 | ~10 | 193,989 | 289,406 |
| Post-$ClO_2$ (30 days) | ~300 | ~125 | 223,929 | 410,152 |
| | +1,500% | +1,250% | +15% | +42% |

Figure 18:
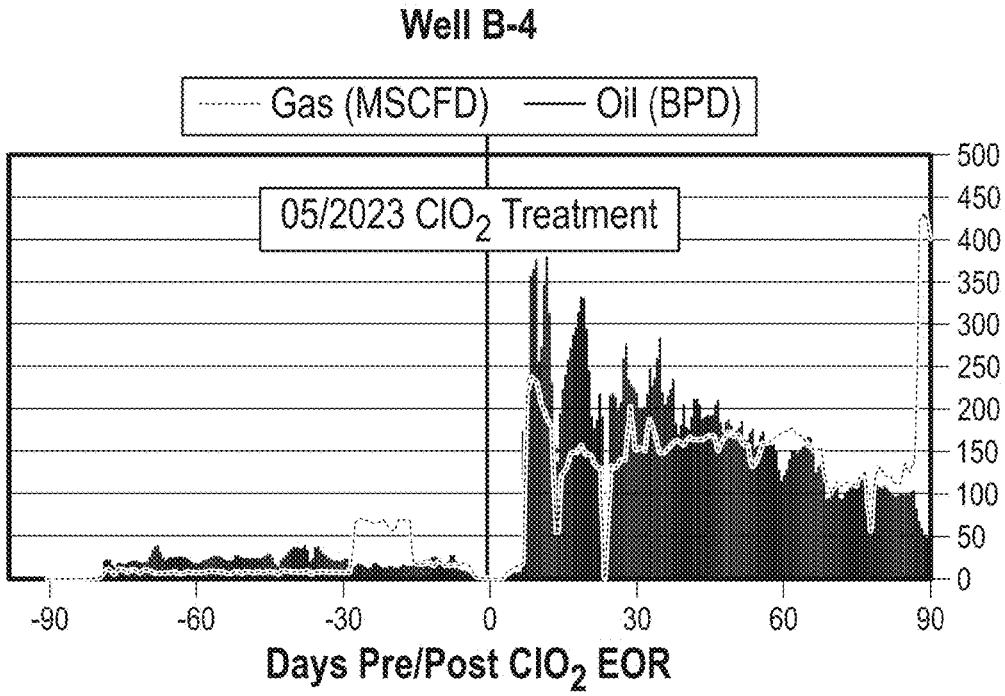
FIG. 18 shows an exemplary production performance and uplift of Well B-4 (Rod Lift to ESP conversion) after ClO2 treatment, in accordance with at least some embodiments.

FIG. 18 shows an exemplary production performance and uplift of Well B-4 (Rod Lift to ESP conversion) after ClO2 treatment.

Figure 19:
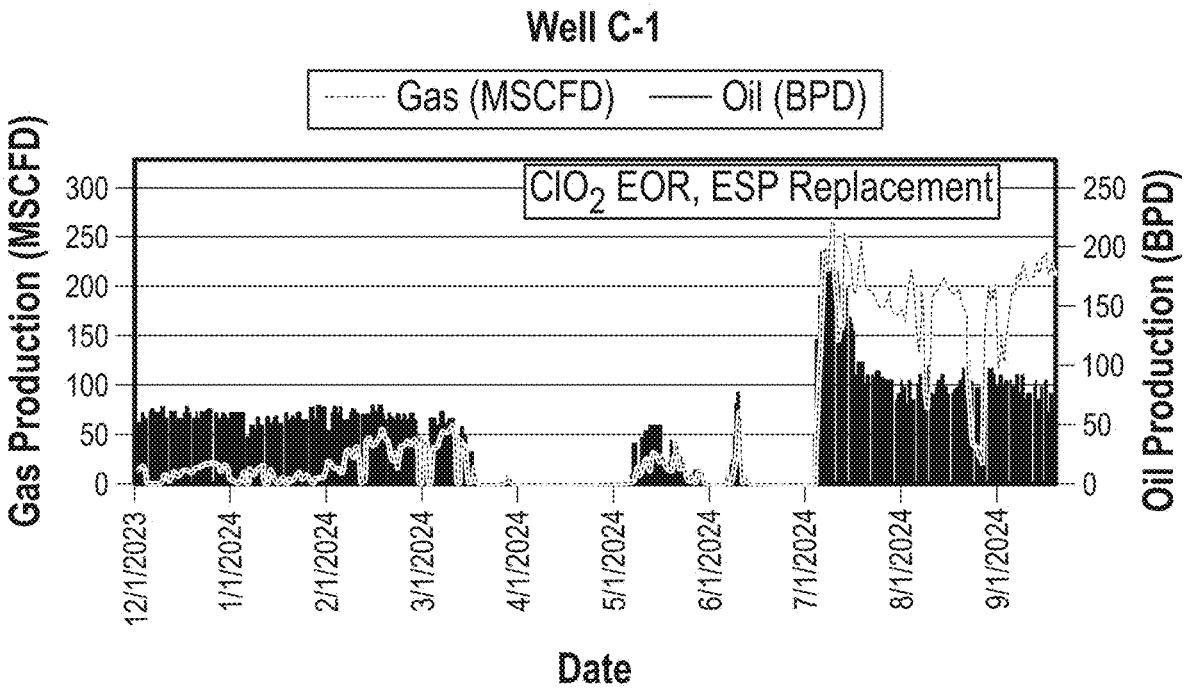
FIG. 19 shows an exemplary production performance and uplift of Well C-1 (Area C—Martin County) after ClO2 treatment, in accordance with at least some embodiments.

In Q2 of 2024, the ClO2 program extended in Martin County (Table 2), and the first treatment was pumped in well C-1. Well C-1 is a Lower Spraberry well. The treatment had to be modified to accommodate for the asphaltene, iron sulfide, and paraffin depositions that were identified in oil/water analysis and from samples collected from downhole equipment. The well was being produced with an ESP system, and after the treatment a similar size pump was installed. FIG. 19 presents the production uplift in relation to the well's production before the ClO2 was pumped. Oil production increased from −45 bopd to >100 bopd and gas from −40 to 225 Mscfd (FIG. 19). FIG. 19 shows an exemplary production performance and uplift of Well C-1 (Area C—Martin County) after ClO2 treatment.

ClO2 treatments have been pumped in more wells targeting different producing zones in the area with encouraging uplift results in oil and gas production.

To evaluate the impact of the ClO2 LOR treatments in the Recovery Factor (RF) improvement for the unconventional Wolfcamp wells, Delaware basin in Reeves County (Area 1), a methodology to estimate the oil and gas in place was performed following the steps described below:

1. Identify and evaluate open hole logs and core samples from pilot wells that had been drilled in the field.
2. Build a stress profile of Wolfcamp and run for every well a fracture propagation model (multi-layer Pseudo-3D) to estimate the Stimulated Reservoir Coverage (SRV) for every individual well taking in consideration (Economides et al, 2002, 2008):
   a. Stress/geo-mechanical profile (Young Modulus, Poisson Ration, Horizontal, Vertical and Minimum In-situ Stress, Fracture Toughness),
   b. Completion schedule (fluid/proppant volume, type of fracturing fluid/proppant, pumping rate, perforation scheme), and
   c. Estimate of total SRV and drainage volume for every well based on frac model results and net lateral length.
3. Develop petrophysical model and estimation of oil and gas in place. This work relied on correlating area core data to log readings to calculate OIP, GIP, TOC, Carbonate/Clay/Shale/Silica content, based on the methodology presented by Asquith & Downey.
4. Correlate the SRV of every well with the petrophysical model and estimate oil and gas in place for each well.

Based on the workflow described above, Table 7 and 8 below present the oil and gas in place for every well of Area 1 in Reeves County. Once the estimation of OIP & GIP was completed, the oil and gas recovery factors for every well were calculated, based on the cumulative production before and after the ClO2 EOR treatments. In Table 7, the RF for oil before and after the treatments are shown, while Table 8 demonstrates the RF for gas. A significant improvement in BOE RF is recorded (FIG. 20), with most of the wells exceeding BOE RF of 10%. All wells are still producing at higher rates than before the ClO2 treatments, and, given the effectiveness of ClO2 to successfully uplift and improve production multiple times, a further improvement in RF is anticipated.

TABLE 7

Estimation of Increase in Oil Recovery Factors for Reeves County Area 1 Wells due to $ClO_2$ EOR
$ClO_2$ EOR Oil Recovery Factors

| Well | OIP (MBO) | BO/FT | Pre RF Oil | Post RF Oil | % Increase |
|---|---|---|---|---|---|
| Well A-0 | 3,994 | 49 | 7.9% | 10.3% | 30% |
| Well A-3 | 2,402 | 17 | 4.6% | 7.2% | 57% |
| Well A-4 | 2,439 | 20 | 4.6% | 8.3% | 80% |

TABLE 7-continued

Estimation of Increase in Oil Recovery Factors for Reeves County Area 1 Wells due to $ClO_2$ EOR
$ClO_2$ EOR Oil Recovery Factors

| Well | OIP (MBO) | BO/FT | Pre RF Oil | Post RF Oil | % Increase |
|---|---|---|---|---|---|
| Well A-8 | 2,798 | 54 | 10.6% | 13.1% | 24% |
| Well A-9 | 1,743 | 93 | 19.1% | 22.6% | 18% |
| Well A-10 | 3,522 | 38 | 6.2% | 9.0% | 45% |

TABLE 8

Estimation of Increase in Gas Recovery Factors for Reeves County Area 1 Wells due to $ClO_2$ EOR
ClO2 EOR Gas Recovery Factors

| Well | GIP (MMSCF) | BOE/FT | Pre RF Gas | Post RF Gas | % Increase |
|---|---|---|---|---|---|
| Well A-0 | 19,018 | 106 | 10.5% | 15.0% | 43% |
| Well A-3 | 11,402 | 42 | 7.6% | 13.3% | 75% |
| Well A-4 | 11,576 | 47 | 6.1% | 14.5% | 136% |
| Well A-8 | 13,354 | 126 | 14.7% | 21.9% | 49% |
| Well A-9 | 8,318 | 219 | 30.8% | 38.5% | 25% |
| Well A-10 | 16,156 | 90 | 8.4% | 15.8% | 88% |

Figure 20:
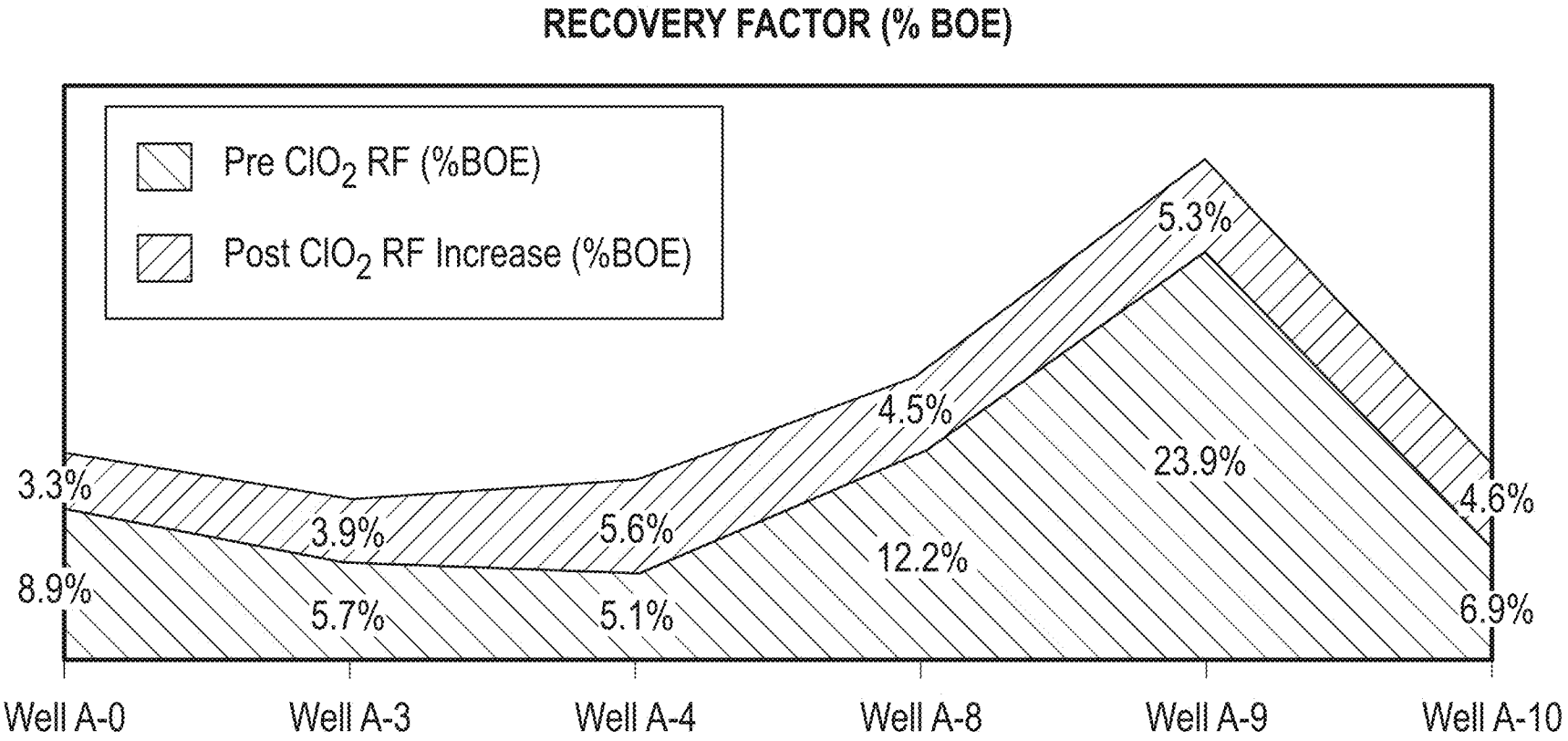
FIG. 20 shows an exemplary recovery factor pre $ClO_2$ & post $ClO_2$ in % barrel of oil equivalent (BOE) as of August 2024, in accordance with at least some embodiments.

FIG. 20 shows an exemplary recovery factor pre ClO2 & post ClO2 in % BOE (as of August 2024).

Since January 2022 and until August 2024, the ClO2 EOR treatments have resulted in an incremental realized production of ~480 MBO and 5.3 BCF (1,385 MBOE) for the wells in Reeves County (Tables 7 & 8). Total production of these wells since D&C is ~1,855 MBO and 14,582 BCF. ClO2 EOR helped to increase cumulative oil and gas production recovery by ~35% and ~57%. A total of 10 ClO2 treatments have been pumped in these 6 wells, with an overall cost of ~$900K.

In at least one aspect, this work introduces to the industry a new methodology of a chemical EOR that could be used to improve production and hydrocarbon recovery in unconventional reservoirs. Through the work conducted the last 3 years, the main conclusions are:

- A new chemical EOR method utilizing $ClO_2$ was successfully used to increase production and EUR in multiple areas and formations of the Permian Basin.
- $ClO_2$ LOR was successfully used in different areas of the Permian Basin (different formations, reservoir PVT properties, oil API gravity, & scale environments), demonstrating a versatile, robust, and effective LOR methodology applicable in different reservoir environments and formations.
- Wells with different types of artificial lift systems were treated, and production improvement was recorded in all cases, even at wells which were considered pumped off and otherwise would have been a case for limited production and EUR uplift based on industry standards.
- $ClO_2$ treatments can be pumped in a few hours, and the treated wells do not require an extended shut-in to achieve a proper and effective soak/inhibition. In contrast, alternative chemical LOR methods trialed by the industry require days of pumping time, large volumes of fluid, and inhibition time up to a month.
- Wells treated multiple times observed an increase in production every time they were treated with $ClO_2$. Oil & Gas EUR improvement in many of these wells exceeds 45%.
- A significant improvement in Oil and Gas RF were achieved, and most of the wells that were treated with $ClO_2$ exceeded the industry "acceptable assumption" of a maximum 10% hydrocarbons recovery.
- Reservoir and production analysis supported the theory that decline is not exclusively related to reservoir depletion, but also to skin damage mechanisms developed inside the fracture system during the production phase. With the successful removal of these damages, $ClO_2$ reestablished the fracture system and wellbore conductivity with the reservoir.

REFERENCES CITED HEREIN

1. Dalamarinis P., Smith B., Fusselman S.: "Acid Restimulation in Legacy Wolfcamp Wells Utilizing Chlorine Dioxide (CLO2). An Operator Case Study of Reservoir Conductivity and Near Wellbore Fracture System Reactivation," URTeC: 3818857 presented at Unconventional Resources Technology Conference, Denver, Colorado, USA, 13-15 Jun. 2023.
2. Logan W. D.; Dalamarinis P.; Williams B.; Urbis K.; Lipari S.: "An Industrialized Approach to Stage-by-Stage Completion Designs," URTeC: 2899869 presented at Unconventional Resources Technology Conference in Houston, Texas, USA, 23-25 Jul. 2018.
3. Dalamarinis P., Mueller P., Logan D., Glascock J., Broll S.: "Real-Time Hydraulic Fracture Optimization Based on the Integration of Fracture Diagnostics and Reservoir Geomechanics," URTeC: 2786 presented at Unconventional Resources Technology Conference, Austin, Texas, USA, 20-22 Jul. 2020.
4. Barba, R. E. (2015). Liquids Rich Organic Shale Recovery Factor Application. Presented at the SPE Annual Technical Conference and Exhibition. https://doi.org/10.2118/174994-MS
5. DOE/National Energy Technology Laboratory, 2019, https://netl.doe.gov/sites/default/files/2019-04/Program-130.pdf
6. Industry Struggles With Enhanced Recovery for Unconventional Reservoirs, JPet Technol 71 (10): 57-58. Paper Number: SPE-1019-0057-JPT.
7. Johannes O. Alvarez, Mohsen Tagavifar, Shashvat Doorwar, DT Vo2, Varadarajan Dwarakanath, Taimur Malik, Dengen Zhou, Jesse Strickle2, Lee (Rusty) Mathis.:" Design of Chemical EOR in Unconventional Reservoirs," URTeC: 3870505, Unconventional Resources Technology Conference, Denver, Colorado, USA, 2023.
8. I. Z. Ataceri, I. W. R. Saputra, A. R. Bagareddy, M. H. Elkady, D. S. Schechter, G. W. Haddix, V. A. Brock2, K. H. Raney, C. W. Strickland, G. R. Morris: "Surfactant EOR Improves Oil Recovery in a Depleted Eagle Ford Unconventional Well—A Case Study, URTeC: 3831548, Unconventional Resources Technology Conference, Denver, Colorado, USA, 2023.
9. Shuler, P. J., Lu, Z., Ma, Q., & Tang, Y. (2016, April 11). Surfactant Huff-n-Puff Application Potentials for Unconventional Reservoirs. Presented at SPE Improved Oil Recovery Conference. https://doi.org/10.2118/179667-MS
10. Radwan A.; Khosrow N.; Ramanathan R.: "Tailored Metal Oxide Nanoparticles-Based Fluids for Production Enhancement via Engineered Uplift Pressure Mechanism: Multi-Basin Case Studies," Paper presented at the SPE/AAPG/SEG Unconventional Resources Technology Conference, Houston, Texas, USA, June 2022. doi: https://doi.org/10.15530/urtec-2022-3722922

11. P. Dalamarinis, A. Radwan, Raja Ramanathan, Abdulaziz Ellafi, Suman Khanal: "Tailored Metal Oxide Nanoparticles-Based Fluids in Acid Restimulation Treatments Reverses Long-Term Hydrocarbon Decline: A Pilot Study in Wolfcamp (A) Formation, ATCE 2023, SPE-215039-MS.
12. Ryan Pagel, Trey Tindall, Tom Pursley, Tim Sweeney, Zack Li, Tim Lathrop, Bob Sullivan, Greg Simpson: Reducing Backpressure and Enhancing Throughput of Saltwater Disposal Wells with Chlorine Dioxide and Complex Nano Fluids: Optimization and Case Studies, SPE-193629-MS, SPE International Conference on Oilfield Chemistry Galveston, Texas, USA, 8-9 Apr. 2019.
13. Zhou Zhang, Pengbo Zhou, Lifang Zhao, Jin Yang: "Experimental Study of the Impact of Chlorine Dioxide on the Permeability of High-Rank Contaminated Coal Reservoirs," ACS Omega, 2021.
14. J. F. McCafferty, E. W. Tate, D. A. Williams, Field Performance in the Practical Application of Chlorine Dioxide as a Stimulation Enhancement Fluid, SPE 20626, 1990 SPE Annual Technical Conference and Exhibition, New Orleans, LA.
15. Economides M. J., Hill D., Ehlig—Economides, C., Zhu, D., Petroleum Production Systems, Second Edition.
16. Marlan W. Downey, Julie Garvin, RC Lagomarsino, David F. Nicklin., A Quick-look Determination of Oil-in-Place in Oil Shale Resource Plays.
17. George B. Asquith and Charles R. Gibson, Basic well log analysis for geologists, 1982.
18. George B. Asquith; Lance Drager; Souvick Saha, "A New Approach To Estimating Sw In Carbonate Reservoir," The Log Analyst, Volume 34, Issue 03, May 1993.
19. George B. Asquith, Reservoir Producibility Index (RPI) From NMR Logs and the Analysis of Tight Oil Reservoirs, Unconventional Resources Technology Conference, July 24-26, 2017 Austin, Texas, USA.
20. M. J. Economides, R. Oligney, P. Valco, Unified Fracture Design, 2002.
21. M. J. Economides, T. Martin, Modern Fracturing, 2008.

Recitation of Embodiments

In one aspect, a method is provided that includes obtaining one or more samples from a petrochemical well, identifying one or more contaminants present in the one or more samples, and, based on the identification of the one or more contaminants present in the one or more samples, identifying a composition and pumping schedule configured to remove the one or more contaminants from the petrochemical well. The one or more samples can comprise one or more oil samples obtained from the petrochemical well. The one or more samples can comprise one or more water samples obtained from the petrochemical well. The one or more samples can comprise one or more solid or scale samples obtained from the petrochemical well. The petrochemical well can comprise an oil well. The petrochemical well can comprise a natural gas well. The one or more contaminants can comprise one or more members selected from the group consisting of: iron sulfide, barium sulfate, strontium sulfide, calcite, biomass, paraffin, asphaltene, biofilm, completion fluids, workover fluids, gels, friction reducers, and any combination thereof. The composition can comprise a mixture of acid and chlorine dioxide (ClO2). The composition can comprise the ClO2 at a concentration between 10 parts per million (ppm) and 20,000 ppm. The composition can further comprise one or more members selected from the group consisting of: water, surfactants, nano surfactants, scale inhibitors, chemical diverters, mechanical diverters, and any combination thereof. The composition can further comprise one or more members selected from the group consisting of: dissolved nitrogen (N2) gas, carbon dioxide (CO2) gas, methane gas, ethane gas, propane gas, butane gas, and any combination thereof. The composition or the pumping schedule can be determined based on a model that incorporates information from one or more members selected from the group consisting of: geological zones contained within the petrochemical well, geochemical zones contained within the petrochemical well, a legacy of pumping within the petrochemical well, a legacy of perforation designs within the petrochemical well, a total number of completed stages within the petrochemical well, a stimulated lateral length within the petrochemical well, and any combination thereof. The model can be generated by: (a) identifying, based on at least one open hole log or at least one core sample from at least one pilot well drilled into the petrochemical well, a formation net pay height, a reservoir permeability, and a reservoir porosity associated with the petrochemical well; (b) determining, based on a proposed hydraulic fracturing schedule, a proppant pack permeability and a proppant pack porosity associated with the petrochemical well; (c) determining, based on (a) and (b), a proppant number, an optimum dimensionless fracture conductivity, and a maximum dimensionless productivity index; (d) determining, from the one or more samples, one or more scale tendencies associated with the petrochemical well; (e) determining, based on (d), one or more diffusivities of components of the composition in the petrochemical well; (f) determining a depth in fracture system or porous medium of the petrochemical well to which the composition should be pumped; and (g) determining, based on (c), (e), and (f), the composition or the pumping schedule. The proposed hydraulic fracturing schedule can comprise one or more members selected from the group consisting of: a proposed fracturing fluid volume, a proposed proppant volume, a proposed fracturing fluid volume, a proposed proppant volume, a proposed hydraulic fracturing pumping rate, a proposed perforation scheme, and any combination thereof. The model can be at least partially configured to simulate a chemical reaction between the one or more contaminants and the composition. The pumping schedule can comprise instructions to pump between 100 barrels (bbls) and 20,000 bbls of the composition through the petrochemical well. The pumping schedule can comprise instructions to pump the composition through the petrochemical well for between 0.5 hours and 10 hours. The pumping schedule can comprise instructions to pump the composition through the petrochemical well at a rate between 1 bbl per minute (bpm) and 40 bpm. In some aspects, the method can further comprise pumping the composition through the petrochemical well according to the pumping schedule based on which the well originally was hydraulic fractured.

In another aspect, systems as shown and/or described herein are provided.

In another aspect, methods as shown and/or described herein are provided.

In another aspect, elements of a system or method as shown and/or described herein are provided.

The present disclosure can be understood more readily by reference to the instant detailed description, examples, and claims. It is to be understood that this disclosure is not limited to the specific systems, devices, and/or methods disclosed unless otherwise specified, as such can, of course, vary. It is also to be understood that the terminology used herein is for the purpose of describing particular aspects only and is not intended to be limiting.

The instant description is provided as an enabling teaching of the disclosure in its best, currently known aspect. Those skilled in the relevant art will recognize that many changes can be made to the aspects described, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the instant description is provided as illustrative of the principles of the present disclosure and not in limitation thereof.

As used herein, the singular forms "a," "an," and "the" include plural referents unless the context clearly dictates otherwise. Thus, for example, reference to a "body" includes aspects having two or more bodies unless the context clearly indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

Although several aspects of the disclosure have been disclosed in the foregoing specification, it is understood by those skilled in the art that many modifications and other aspects of the disclosure will come to mind to which the disclosure pertains, having the benefit of the teaching presented in the foregoing description and associated drawings. It is thus understood that the disclosure is not limited to the specific aspects disclosed hereinabove, and that many modifications and other aspects are intended to be included within the scope of the appended claims. Moreover, although specific terms are employed herein, as well as in the claims that follow, they are used only in a generic and descriptive sense, and not for the purposes of limiting the described disclosure.

What is claimed is:

1. A method comprising:

obtaining one or more samples from a petrochemical well;

identifying one or more contaminants present in the one or more samples; and based on the identification of the one or more contaminants present in the one or more samples, using a model to identify a composition and pumping schedule configured to remove the one or more contaminants from the petrochemical well, wherein the composition or the pumping schedule is determined based on a model that incorporates information from one or more members selected from the group consisting of: geological zones contained within the petrochemical well, geochemical zones contained within the petrochemical well, a legacy of pumping within the petrochemical well, a legacy of perforation designs within the petrochemical well, a total number of completed stages within the petrochemical well, a stimulated lateral length within the petrochemical well, and any combination thereof, and wherein the model is at least partially configured to simulate a chemical reaction between the one or more contaminants and the composition.

2. The method of claim 1, wherein the pumping schedule comprises instructions to pump between 100 barrels (bbls) and 20,000 bbls of the composition through the petrochemical well.

3. The method of claim 1, wherein the pumping schedule comprises instructions to pump the composition through the petrochemical well for between 0.5 hours and 10 hours.

4. The method of claim 1, wherein the pumping schedule comprises instructions to pump the composition through the petrochemical well at a rate between 1 bbl per minute (bpm) and a number of bpm at which the well was originally pumped.

5. The method of claim 1, wherein the one or more samples obtained from the petrochemical well comprise (1) one or more oil samples or (2) one or more water samples.

6. The method of claim 1, wherein the petrochemical well comprises an oil well or a natural gas well.

7. The method of claim 1, wherein the one or more contaminants comprise one or more members selected from the group consisting of: iron sulfide, barium sulfate, strontium sulfide, calcite, biomass, paraffin, asphaltene, biofilm, completion fluids, workover fluids, gels, friction reducers, and any combination thereof.

8. The method of claim 1, wherein the composition comprises a mixture of acid and chlorine dioxide ($ClO_2$).

9. The method of claim 8, wherein the composition comprises the $ClO_2$ at a concentration between 10 parts per million (ppm) and 20,000 ppm.

10. The method of claim 8, wherein the composition further comprises (1) one or more members selected from the group consisting of: water, surfactants, nano surfactants, scale inhibitors, chemical diverters, mechanical diverters, and any combination thereof, or (2) one or more members selected from the group consisting of: dissolved nitrogen ($N_2$) gas, carbon dioxide ($CO_2$) gas, methane gas, ethane gas, propane gas, butane gas, and any combination thereof.

11. A method comprising:

obtaining one or more samples from a petrochemical well;

identifying one or more contaminants present in the one or more samples; and based on the identification of the one or more contaminants present in the one or more samples, using a model to identify a composition and pumping schedule configured to remove the one or more contaminants from the petrochemical well, wherein the composition or the pumping schedule is determined based on a model that incorporates information from one or more members selected from the group consisting of: geological zones contained within the petrochemical well, geochemical zones contained within the petrochemical well, a legacy of pumping within the petrochemical well, a legacy of perforation designs within the petrochemical well, a total number of completed stages within the petrochemical well, a stimulated lateral length within the petrochemical well, and any combination thereof by:

(a) identifying, based on at least one open hole log or at least one core sample from at least one pilot well drilled into the petrochemical well, a formation net pay height, a reservoir permeability, and a reservoir porosity associated with the petrochemical well;

(b) determining, based on a proposed hydraulic fracturing schedule, a proppant pack permeability and a proppant pack porosity associated with the petrochemical well;

(c) determining, based on (a) and (b), a proppant number, an optimum dimensionless fracture conductivity, and a maximum dimensionless productivity index;

(d) determining, from the one or more samples, one or more scale tendencies associated with the petrochemical well;

(e) determining, based on (d), one or more diffusivities of components of the composition in the petrochemical well;

(f) determining a depth in fracture system or porous medium of the petrochemical well to which the composition should be pumped; and (g) determining, based on (c), (e), and (f), the composition or the pumping schedule.

12. The method of claim 11, wherein the one or more samples comprise one or more oil samples or one or more water samples obtained from the petrochemical well.

13. The method of claim 11, wherein the petrochemical well comprises an oil well or a natural gas well.

14. The method of claim 11, wherein the one or more contaminants comprise one or more members selected from the group consisting of: iron sulfide, barium sulfate, strontium sulfide, calcite, biomass, paraffin, asphaltene, biofilm, completion fluids, workover fluids, gels, friction reducers, and any combination thereof.

15. The method of claim 11, wherein the composition comprises a mixture of acid and chlorine dioxide ($ClO_2$).

16. The method of claim 15, wherein the composition comprises the $ClO_2$ at a concentration between 10 parts per million (ppm) and 20,000 ppm.

17. The method of claim 15, wherein the composition further comprises one or more members selected from the group consisting of: water, surfactants, nano surfactants, scale inhibitors, chemical diverters, mechanical diverters, and any combination thereof.

18. The method of claim 15, wherein the composition further comprises one or more members selected from the group consisting of: dissolved nitrogen ($N_2$) gas, carbon dioxide ($CO_2$) gas, methane gas, ethane gas, propane gas, butane gas, and any combination thereof.

19. The method of claim 11, wherein the proposed hydraulic fracturing schedule comprises one or more members selected from the group consisting of: a proposed fracturing fluid volume, a proposed proppant volume, a proposed hydraulic fracturing pumping rate, a proposed perforation scheme, and any combination thereof.

20. The method of claim 11, wherein the pumping schedule comprises (1) instructions to pump between 100 barrels (bbls) and 20,000 bbls of the composition through the petrochemical well, (2) instructions to pump the composition through the petrochemical well for between 0.5 hours and 10 hours, or (3) instructions to pump the composition through the petrochemical well at a rate between 1 bbl per minute (bpm) and a number of bpm at which the well was originally pumped.

* * * * *